US012209411B2

(12) United States Patent
Budd

(10) Patent No.: US 12,209,411 B2
(45) Date of Patent: Jan. 28, 2025

(54) SYSTEMS AND METHODS FOR ANCHORING CURTAINWALLS

(71) Applicant: New Hudson Facades, LLC, New York, NY (US)

(72) Inventor: Michael Budd, Devon, PA (US)

(73) Assignee: NEW HUDOM FACADES, LLC, New York, NY (US)

( * ) Notice: Subject to any disclaimer, the term of this patent is extended or adjusted under 35 U.S.C. 154(b) by 4 days.

(21) Appl. No.: 18/183,010

(22) Filed: Mar. 13, 2023

(65) Prior Publication Data

US 2023/0295920 A1 Sep. 21, 2023

Related U.S. Application Data

(63) Continuation of application No. 17/191,138, filed on Mar. 3, 2021, now Pat. No. 11,692,346.

(51) Int. Cl.
*E04B 2/90* (2006.01)
*E04B 1/41* (2006.01)

(52) U.S. Cl.
CPC . *E04B 2/90* (2013.01); *E04B 1/41* (2013.01)

(58) Field of Classification Search
CPC ..... E04B 2/90; E04B 1/41; E04B 2/88; E04B 2/885; E04B 2/96; E04B 2/962; E04B 2/965; E04B 2/967
USPC ..... 52/235, 483.1, 489.1, 506.05, 512, 698
See application file for complete search history.

(56) References Cited

U.S. PATENT DOCUMENTS

| | | | | |
|---|---|---|---|---|
| 3,834,099 | A * | 9/1974 | Haeussler | E04F 13/0853 52/378 |
| 5,077,947 | A * | 1/1992 | Takeda | E04B 2/94 52/235 |
| 5,216,858 | A * | 6/1993 | Gilmour | E04B 2/96 52/489.1 |
| 9,752,319 | B1 * | 9/2017 | LeVan | E04B 2/965 |
| 10,724,234 | B2 * | 7/2020 | LeVan | E04B 2/965 |
| 11,692,346 | B2 | 7/2023 | Budd | |
| 2013/0051903 | A1 * | 2/2013 | Ra | E04B 2/90 403/205 |

(Continued)

OTHER PUBLICATIONS

U.S. Appl. No. 17/191,138, filed Mar. 3, 2021, Systems and Methods for Anchoring Curtainwalls.

(Continued)

*Primary Examiner* — Brian E Glessner
*Assistant Examiner* — Adam G Barlow
(74) *Attorney, Agent, or Firm* — SCHWEGMAN LUNDBERG & WOESSNER, P.A.

(57) ABSTRACT

An anchoring system for anchoring curtainwall units may include an anchor base structure to be attached to the floor slab, a vertical anchor structure and a horizontal anchor structure. The vertical anchor structure may be connected to a lower portion of the upper row curtainwall unit and bear a load of the upper row curtainwall unit on the anchor base structure, thereby fixing a distance between the floor slab and the lower portion of the upper row curtainwall unit while allowing horizontal motion. The horizontal anchor structure may be configured to be connected to an upper portion of the lower row curtainwall unit, and to use the anchor base structure to secure the upper portion of the lower row curtainwall unit against horizontal motion while allowing vertical motion.

20 Claims, 24 Drawing Sheets

(56) References Cited

U.S. PATENT DOCUMENTS

| | | | | |
|---|---|---|---|---|
| 2014/0157699 | A1* | 6/2014 | Moeller | E04B 2/88 52/235 |
| 2017/0204600 | A1* | 7/2017 | Daudet | E04B 1/98 |
| 2019/0093349 | A1* | 3/2019 | LeVan | E04B 2/885 |
| 2021/0140173 | A1* | 5/2021 | Grise | E04B 2/90 |
| 2021/0404181 | A1* | 12/2021 | Naim Ibrahim | E04B 1/68 |
| 2022/0025651 | A1* | 1/2022 | White | E04B 1/948 |
| 2022/0098888 | A1* | 3/2022 | Richard | E04H 9/021 |
| 2022/0282479 | A1 | 9/2022 | Budd | |

OTHER PUBLICATIONS

"U.S. Appl. No. 17/191,138, Examiner Interview Summary mailed Feb. 3, 2023", 2 pgs.
"U.S. Appl. No. 17/191,138, Final Office Action mailed Nov. 21, 2022", 8 pgs.
"U.S. Appl. No. 17/191,138, Non Final Office Action mailed May 23, 2022".
"U.S. Appl. No. 17/191,138, Notice of Allowance mailed Feb. 22, 2023", 8 pgs.
"U.S. Appl. No. 17/191,138, Preliminary Amendment filed Mar. 8, 2021", 3 pgs.
"U.S. Appl. No. 17/191,138, Response filed Feb. 3, 2023 to Final Office Action mailed Nov. 21, 2022", 11 pgs.
"U.S. Appl. No. 17/191,138, Response filed Aug. 23, 2022 to Non Final Office Action mailed May 23, 2022", 20 pgs.

* cited by examiner

SYSTEMS AND METHODS FOR ANCHORING CURTAINWALLS

TECHNICAL FIELD

This document relates generally to building construction, and more particularly, but not by way of limitation, to systems and methods for anchoring curtainwalls to a building.

BACKGROUND

Unitized curtainwall is an exterior cladding product for buildings that is prefabricated and preassembled prior to shipment to the project site. Advantages of preassembly may include improved quality as the product may be preassembled in a clean and dry environment, reduced costs as the cost of factory labor is usually significantly less than field labor, and improved scheduling as the curtainwall product can be preassembled before installation resulting in reduced on-site installation time.

The primary building structure may have & one inch to two-inch tolerance or more relative to theoretical positioning, whereas the curtainwall system may have an ⅛-inch to 1/16-inch tolerance. The curtainwall systems are designed to accommodate these variations in structural as-built positioning with the use of adjustable anchorage components, and are also designed with movable joints to accommodate relative movement between the building structures and curtainwall units. As understood by those of ordinary skill in construction industry, the movement may be caused by various mechanisms. For example, floor deflection may be caused by human traffic, office furniture, or machine traffic. Movement may also be caused by machine vibrations, thermal expansion and contraction, wind sway, seismic events, and settling of the primary structural system.

The prefabricated and preassembled curtainwall units may be anchored to building floor slabs. As will be discussed in more detail below, conventional curtainwall systems are anchored by fixing a top portion of a curtain wall unit to a floor slab while a bottom portion of the curtainwall unit hangs below that floor slab and mates with another curtainwall unit at & stack joint. The hanging bottom portion of the curtainwall unit has limited freedom of motion to allow vertical motion at a movable stack joint between curtainwall units, and thereby accommodate building primary structural system motion from wind, thermal expansion, traffic, and the like. The fixed anchoring of the top portion of the curtainwall unit to the floor slab supports the vertical gravity load and horizontal lateral (wind and seismic) load of the curtain wall and causes the attached curtainwall unit to ride with that floor slab.

SUMMARY

This document discusses, among other things, unitized curtainwall systems, and more particularly systems and methods for anchoring curtainwalls to a building. The anchoring fixes a bottom portion of the curtainwall unit to a floor slab to thereby support the deadweight or vertical load of the curtainwall unit while a top portion of the curtainwall unit is supported against a horizontal/lateral movement and load (e.g., wind/seismic) while allowing vertical motion as required for the movable stack joint. A benefit of the design may include, but is not necessarily limited to, greater architectural design flexibility such as the ability to securely fix sill trim between the lower portion of the curtainwall unit and the floor slab directly below it.

An example (e.g. "Example 1") of an anchoring system may be configured to anchor at least a lower row curtainwall unit and an upper row curtainwall unit of a unitized curtainwall system to a floor slab of a building structure. The anchoring system may include an anchor base structure configured to be attached to the floor slab, a vertical anchor structure and a horizontal anchor structure. The vertical anchor structure may be configured to be connected to a lower portion of the upper row curtainwall unit and configured to bear a load of the upper row curtainwall unit on the anchor base structure, thereby fixing a distance between the floor slab and the lower portion of the upper row curtainwall unit while allowing horizontal motion of the lower portion of the upper row curtainwall structure. The horizontal anchor structure may be configured to be connected to an upper portion of the lower row curtainwall unit, and to use the anchor base structure to secure the upper portion of the lower row curtainwall unit against horizontal motion while allowing vertical motion of the upper portion of the lower row curtainwall unit In Example 2, the subject matter of Example 1 may optionally be configured such that the anchor base structure includes a horizontally-oriented lip generally parallel to and aligned proximate to an edge of the floor slab when the anchor base structure is attached to the floor slab.

In Example 3, the subject matter of Example 2 may optionally be configured such that the horizontal anchor structure includes an anchor hook including a lower recess having a shape configured to receive the lip of the base plate when the anchor hook is on the lip, and including a vertically-oriented pin portion, and an anchor slide configured to be attached to the top portion of the lower row curtainwall unit. The anchor slide may include a vertically-oriented groove configured to receive the vertically-oriented pin portion when the vertically-oriented pin portion is slid into the anchor slide, and the pin portion is configured to cooperate with the anchor slide to secure the top portion of the lower row curtain wall unit to the floor slab against horizontal motion while allowing vertical motion In Example 4, the subject matter of any one or any combination of Examples 2-3 may optionally be configured such that the vertical anchor structure includes an anchor hook including a lower recess having a shape configured to receive the lip of the base plate when the anchor hook is on the lip, a dead load shim configured to be installed on the anchor hook, and a deadload bracket configured to be connected to a bottom portion of the upper row curtainwall unit. The deadload bracket, dead load shim and the anchor hook on the anchor plate are configured to cooperate to bear the load of the upper row curtainwall unit on the anchor base structure, thereby fixing the distance between the floor slab and the lower portion of the upper row curtainwall unit, and to allow horizontal motion of the lower portion of the upper row curtainwall structure In Example 5, the subject matter of Example 4 may optionally be configured such that the deadload bracket is configured with a flat, plate-shaped extension configured to contact the top of the dead load shim, thereby bearing the load of the upper row curtainwall unit on the dead load shim while allowing horizontal motion.

In Example 6, the subject matter of Example 5 may optionally be configured such that the deadload bracket is configured with a shape for insertion into horizontal sills of the curtainwall units, wherein the horizontal sills have a notch through which the flat, plate-shaped extension is configured to extend.

In Example 7, the subject matter of any one or any combination of Examples 2-6 may optionally be configured such that the anchor hook includes a body with a fin-shape having a width less than a length and a height, a vertically-oriented pin portion, and a lower recess having a shape configured to receive the lip of the base plate when the anchor hook is on the lip.

In Example 8, the subject matter of Example 7 may optionally be configured such that the anchor hook includes a tapped aperture and a set screw in the tapped aperture. The set screw may be configured to be screwed into contact with the base plate to secure the anchor hook from movement along the lip of the base plate.

In Example 9, the subject matter of any one or any combination of Examples 2-7 may optionally be configured such that the dead load shim has a vertically-oriented groove configured to receive the vertically-oriented pin portion when the dead load shim is slid over the vertically-oriented pin portion.

In Example 10, the subject matter of Example 9 may optionally be configured such that the dead load shim includes a tapped aperture and a set screw in the tapped aperture. The set screw may be configured to be screwed into contact with a top of the pin portion to adjust a height of an upper surface of the dead load shim that contacts the flat plate-shaped extension of the deadload bracket.

In Example 11, the subject matter of any one or any combination of Examples 2-10 may optionally be configured such that the anchor base structure includes at least two slots generally perpendicular to the edge of the floor slab when the anchor base structure is attached to the floor slab. Each of the at least two slots may be configured to allow at least one bolt to extend through for use in securing the base structure to the floor slab.

In Example 12, the subject matter of any one or any combination of Examples 2-11 may optionally be configured such that the lip of the anchor base structure has a length along the edge of the floor slab for two installed anchor hooks used to anchor two horizontally adjacent curtainwall units An example (e g. "Example 13") of an anchoring system may be configured to anchor at least a lower row curtainwall unit and an upper row curtainwall unit of a unitized curtainwall system to a floor slab. The anchoring system may include an anchor slide configured to be attached to a top portion of the lower row curtainwall unit, a deadload bracket configured to be connected to a bottom portion of the upper row curtainwall unit, an anchor base plate configured to be attached to a floor slab where the anchor base plate includes a horizontally-orientated lip, as anchor hook including a lower recess having a shape configured to receive the lip of the base plate when the anchor hook is on the lip and includes a vertically-oriented pix portion configured to slide into the anchor slide, and a dead load shim configured to be installed on the anchor hook. The dead load shim has a vertically-oriented groove configured to receive the vertically-oriented pin portion when the dead load shim is slid over the vertically oriented pin portion. The deadload bracket that is connected to the bottom portion of the upper row curtainwall unit is configured to rest on the dead load shim. The lower recess of the anchor hook is configured to cooperate with the lip of the anchor base plate and the pin portion is configured to cooperate with the anchor slide to secure the top portion of the lower row curtain wall unit to the floor slab while allowing vertical motion. The deadload bracket, dead load shim and the anchor hook on the anchor plate are configured to cooperate to bear a load of the upper row curtainwall unit and fix a distance between the lower portion of the upper row curtain wall unit and the floor slab while allowing horizontal motion of the lower portion of the upper row curtainwall structure.

In Example 14, the subject matter of Example 13 may optionally be configured such that the anchor hook includes a tapped aperture and a set screw in the tapped aperture. The set screw may be configured to be screwed into contact with the base plate to secure the anchor hook from movement along the lip of the base plate.

In Example 15, the subject matter of any one or any combination of Examples 13-14 may optionally be configured such that the dead load shim includes a tapped aperture and a set screw in the tapped aperture. The set screw may be configured to be screwed into contact with a top of the pin portion to adjust a height of an upper surface of the dead load shim that contacts the flat, plate-shaped extension of the deadload bracket.

In Example 16, the subject matter of any one or any combination of Examples 13-15 may optionally be configured such that the lip of the anchor base plate has a length along the edge of the floor slab for two installed anchor hooks used to anchor horizontally adjacent curtainwall units.

An example (e.g "Example 17") of a method may install a unitized curtainwall system having a plurality of curtain wall units including at least a lower row curtainwall unit and an upper row curtainwall unit. The method may include attaching an anchor base structure to a floor slab, installing the upper row curtainwall unit over the lower row curtainwall unit, and installing an anchor structure on the anchor base structure. The installing the anchor structure on the anchor base structure may include securing the upper portion of the lower row curtainwall unit to the floor slab against horizontal motion while allowing vertical motion of the upper portion of the lower row curtainwall unit, and bearing a load of the upper row curtainwall unit on the anchor base structure, thereby fixing a distance between the floor slab and the lower portion of the upper row curtainwall unit, while allowing horizontal motion of the lower portion of the upper row curtainwall structure In Example 18, the subject matter of Example 17 may optionally include using the anchor base plate to anchor an adjacent lower row curtainwall unit and upper row curtain wall unit to the floor slab.

In Example 19, the subject matter of any one or any combination of Examples 17-18 may optionally be configured such the anchor base structure includes a horizontally-oriented lip generally parallel to and aligned proximate to an edge of the floor slab when the anchor base structure is attached to the floor slab. The anchor structure may include an anchor hook having a lower recess with a shape configured to receive the lip of the base plate when the anchor hook is on the lip, and a vertically-oriented pin portion, and a dead load shim configured to be installed over the vertically-oriented pin portion of the anchor hook. The securing the upper portion of the lower row curtainwall unit to the floor slab against horizontal motion while allowing vertical motion of the upper portion of the lower row curtainwall unit may include sliding the vertically-oriented pin portion into an anchor slide attached to a top portion of the lower row curtainwall unit and placing the lower recess of the anchor hook over the lip of the anchor base plate. The lower recess of the anchor hook may be configured to cooperate with the lip of the anchor base plate and the pin portion is configured to cooperate with the anchor slide to secure the top portion of the lower row curtain wall unit to the floor slab while allowing vertical motion. The bearing the load of the upper row curtainwall unit on the anchor base structure may include resting a deadload bracket connected to a lower portion of the upper row curtainwall unit onto a top surface of a dead load shim installed over the vertically-oriented pin portion.

In Example 20, the subject matter of Example 19 may optionally be configured such that the anchor hook includes a tapped aperture and a set screw in the tapped aperture. The method may further include securing the anchor hook from movement along the lip of the base plate by screwing the set screw into contact with the base plate In Example 21, the subject matter of any one or any combination of Examples 17-20 may optionally be configured such that the dead load shim includes a tapped aperture and a set screw in the tapped aperture. The set screw may be configured to be in contact with a top of the pin portion. The method may further Include adjusting a height of an upper surface of the dead load shim that contacts the flat, plate-shaped extension of the deadload bracket by rotating the set screw to either raise the height of the upper surface or rotating the set screw to decrease the height of the upper surface.

An example (e.g. "Example 22") of a method may install a unitized curtainwall system having a plurality of curtain wall units including at least a lower row curtainwall unit and an upper row curtainwall unit. The method may include attaching an anchor base plate to a floor slab, where the anchor base plate includes a lip. The method may further include sliding a pin portion of an anchor hook into an anchor slide attached to a top portion of the lower row curtainwall unit and placing a lower recess of the anchor hook over the lip of the anchor base plate. The lower recess of the anchor hook may be configured to cooperate with the lip of the anchor base plate and the pin portion is configured to cooperate with the anchor slide to secure the top portion of the lower row curtain wall unit to the floor slab while allowing vertical motion. The method may include installing a dead load shim on the anchor hook onto the pin portion of the anchor hook, and installing the upper row curtainwall unit over the lower row curtainwall unit. The upper row curtainwall unit may include a deadload bracket extending from a bottom portion of the lower row curtainwall unit and configured to rest on the dead load shim. The deadload bracket, dead load shim and the anchor hook on the anchor plate are configured to cooperate to fix a distance between the lower portion of the upper row curtain wall unit and the floor slab.

In Example 23, the subject matter of Example 22 may optionally be configured to include using the anchor base plate to anchor an adjacent lower row curtainwall unit and upper row curtain wall unit to the floor slab.

In Example 24, the subject matter of any one or any combination of Examples 22-23 may optionally be configured such that the anchor hook includes a tapped aperture and a set screw in the tapped aperture. The method further may include securing the anchor hook from movement along the lip of the base plate by screwing the set screw into contact with the base plate In Example 25, the subject matter of any one or any combination of Examples 22-24 may optionally be configured such that the dead load shim includes a tapped aperture and a set screw in the tapped aperture. The set screw may be configured to be in contact with a top of the pin portion. The method further may include adjusting a height of an upper surface of the dead load shim that contacts the flat plate-shaped extension of the deadload bracket by rotating the set screw to either raise the height of the upper surface or rotating the set screw to decrease the height of the upper surface.

This summary is intended to provide an overview of subject matter of the present patent application. It is not intended to provide an exclusive or exhaustive explanation of the disclosure. The detailed description is included to provide further information about the present patent application. Other aspects of the disclosure will be apparent to persons skilled in the art upon reading and understanding the following detailed description and viewing the drawings that form a part thereof, each of which are not to be taken in a limiting sense.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document

DETAILED DESCRIPTION

Figure 1:
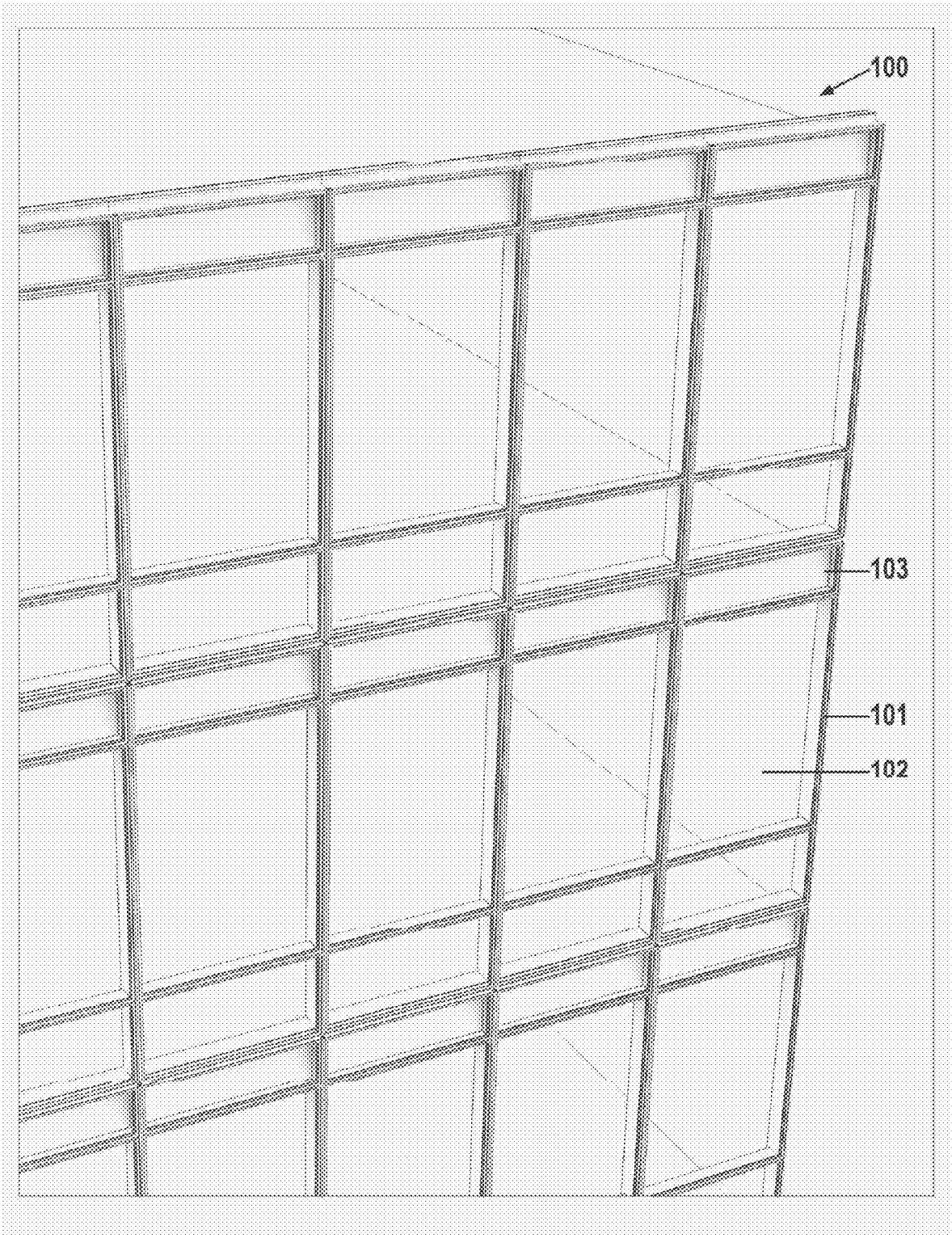
FIG. 1 illustrates an example of a curtainwall system.

FIG. 1 illustrates an example of a curtainwall system 100. The curtainwall system 100 may include a plurality of prefabricated curtainwall units 101 that can be quickly installed to provide a building with exterior cladding. Each of the prefabricated curtainwall units 101 may include a vision area 102 and a spandrel area 103. The vision area 102 may provide visual access through the curtainwall. From the exterior of the building with an installed curtainwall system, the spandrel area 103 may eliminate visual access through the curtain wall units to the floor slab or other parts of the structure For example, curtainwall units 101 may be formed in rows and columns to form an array of curtainwall units. Thus, a given curtainwall unit may have other units immediately adjacent in a horizontal direction and in a vertical direction. The illustrated building structure is a relatively simple rectilinear shape. Curtainwall systems may be implemented on more complex architectural designs that are not limited to rectilinear shapes.

Figure 2A:
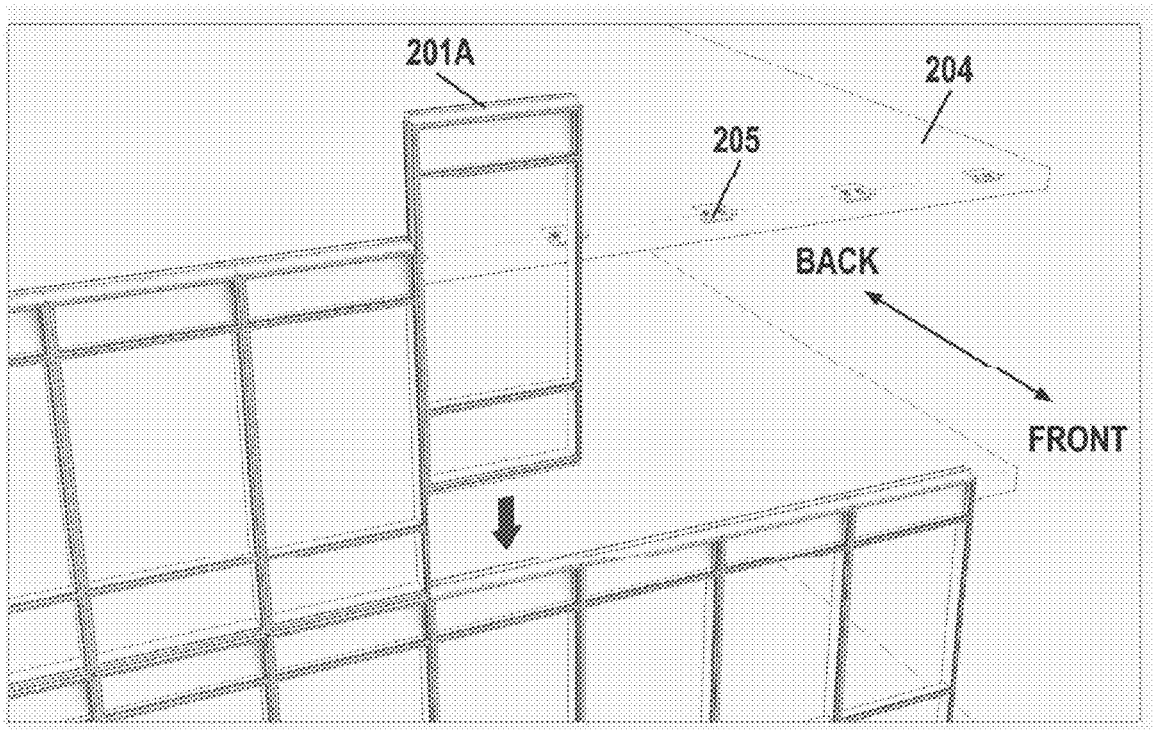
FIGS. 2A-2B illustrate an example of a curtainwall installation sequence, including conventional anchoring of a top portion of the curtainwall units to a floor slab.
Figure 2B:
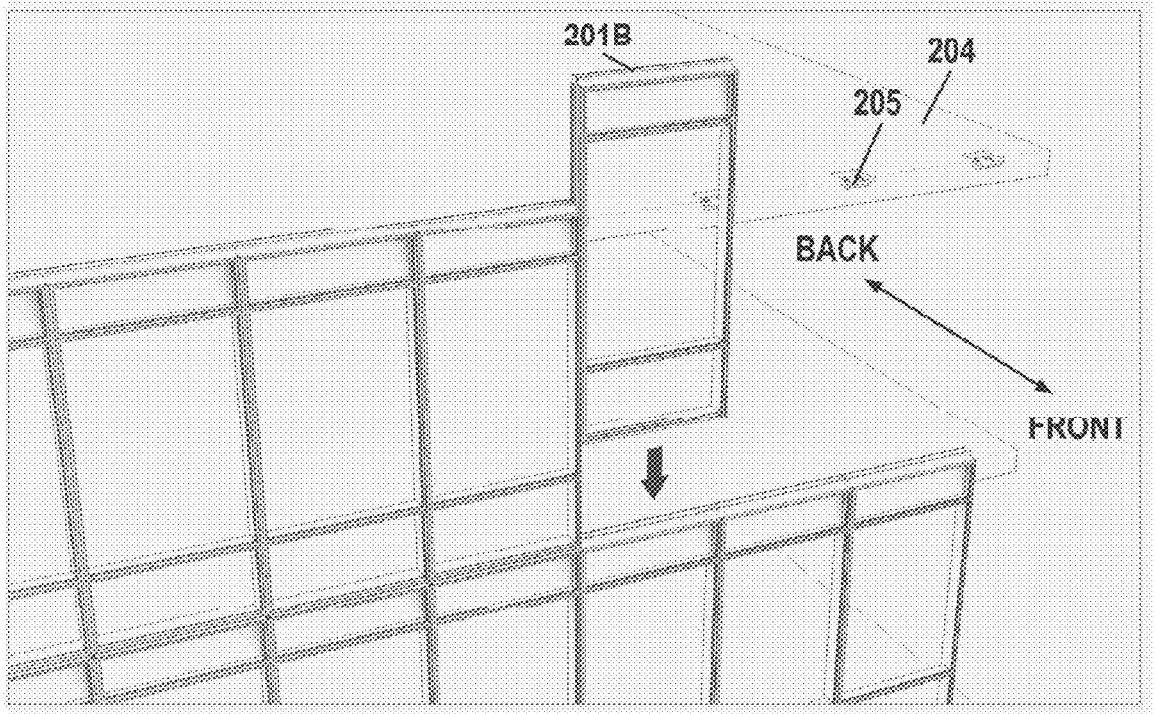
Figure 3A:
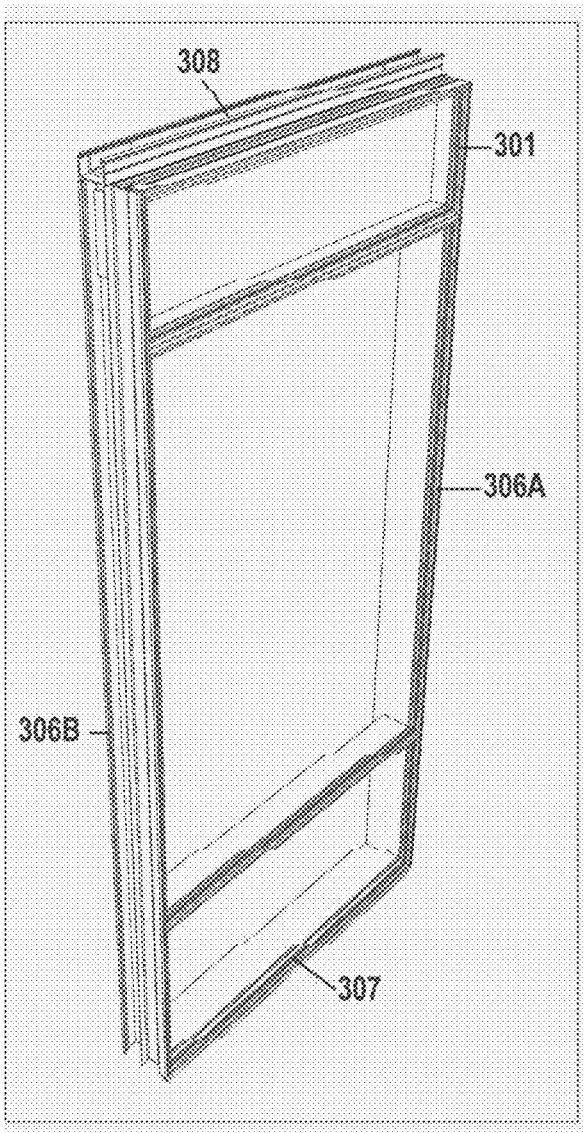
FIGS. 3A-3D illustrate perspective views of an example of a curtainwall unit.
Figure 3B:
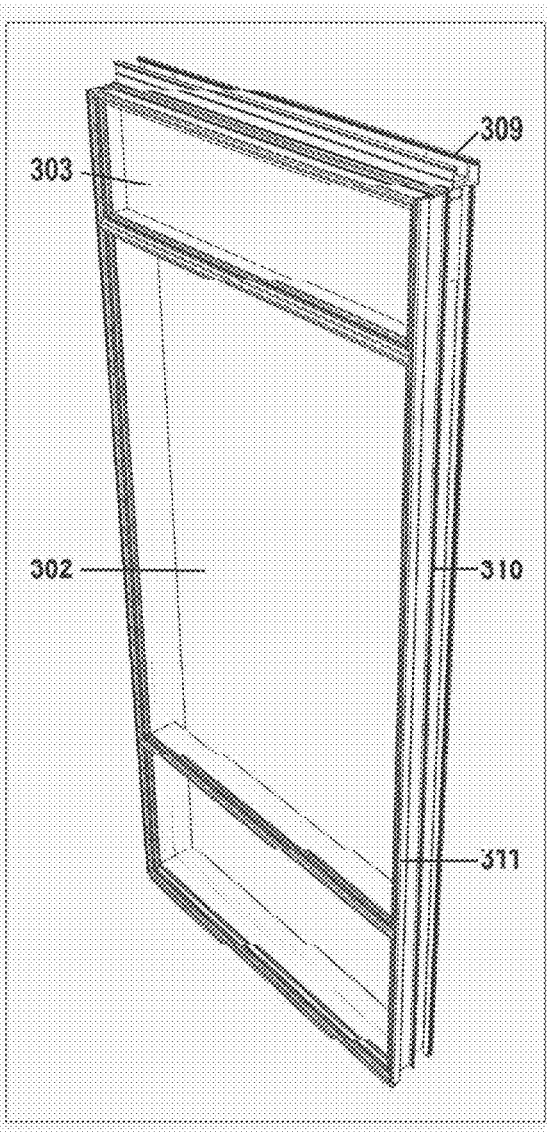
Figure 3C:
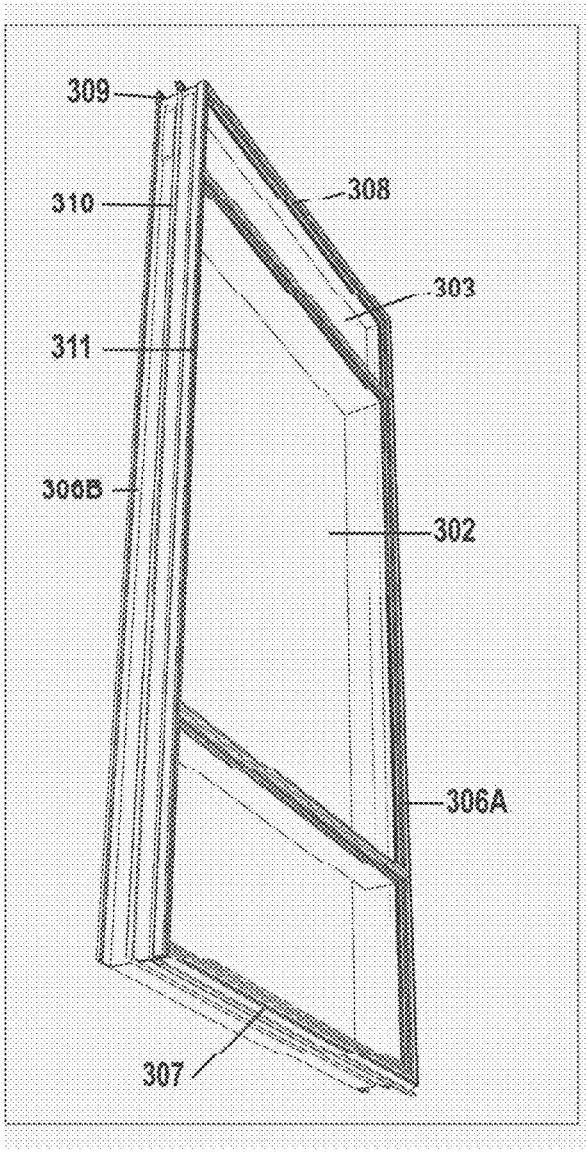
Figure 3D:
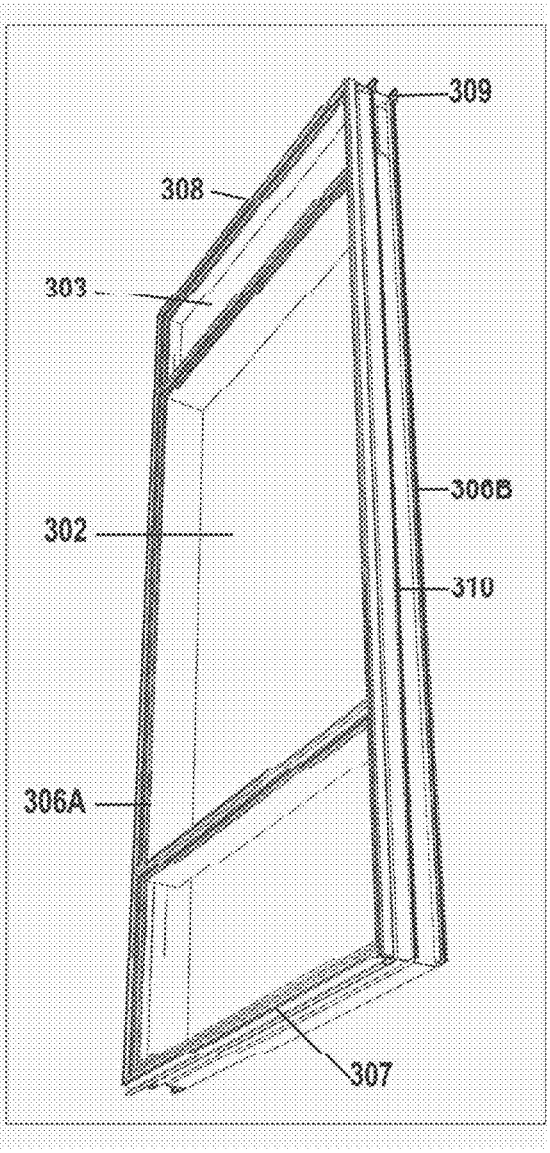

FIGS. 2A-2B illustrate an example of a curtainwall installation sequence, including conventional anchoring of a top portion of the curtainwall units to a floor slab. The curtainwall units 201A and 201B may be slid in place next to each other, and provide a sealing fit with each other Each unit has a main frame that may be formed from extruded aluminum. The vertical frame members may be referred to as vertical mullions, the bottom horizontal frame member may be referred to as a sill, and the top horizontal frame member may be referred to as a gutter. The perimeter framing members of a unitized curtainwall system may be designed with gaskets and male/female mating aluminum extrusions which, when fitted together, create an air and water barrier between the interior and exterior The curtainwall units may be attached or anchored to the floor slab 204 using anchor components attached to the back of the curtainwall units that hang on brackets such as the brackets 205 illustrated in FIGS. 2A-2B.

FIGS. 3A-3D illustrate perspective views of an example of a curtainwall unit 301 used during the installation sequence illustrated in FIGS. 2A-2B. The curtainwall unit 301 may include vertical mullions 306A and 306B, sill 307, and gutter 308. By way of example, the curtainwall unit may also include gaskets used to form an air seal 309, a water seal 310, and a rainscreen 311. The water seal 310 and the air seal 309 may be water tight. The rainscreen 311 may not be water tight. The curtain wall unit 301 may also include a vision area 302, and a spandrel area 303. The gutter 308 may facilitate the drainage of fluid from an area between the air seal 309 and water seal 310 to the exterior in front of the installed curtainwall system. The air seal 309 may extend along a perimeter of the curtainwall unit 301 and may form an air seal gasket line. Putty, such as a silicone putty plug may be used to supplement the air seal 309, such as where gaps exist between adjacent curtainwall units 301. The water seal 310 may extend along a perimeter of the curtainwall unit 301 and may form a water seal gasket line. The water seal 310 may provide a watertight joint. The rainscreen 311 may extend along a perimeter of the curtainwall unit 301 and may form a rainscreen gasket line. The rainscreen may be designed with gaps in the rainscreen gasket line to allow water to weep out to the exterior, and to allow pressure equalization of interior cavities of the curtainwall system 100. In an installed system, adjacent units may form a front cavity between the rainscreen 311 and the water seal 310 and a rear cavity between the water seal 310 and the air seal 309.

Figure 4A:
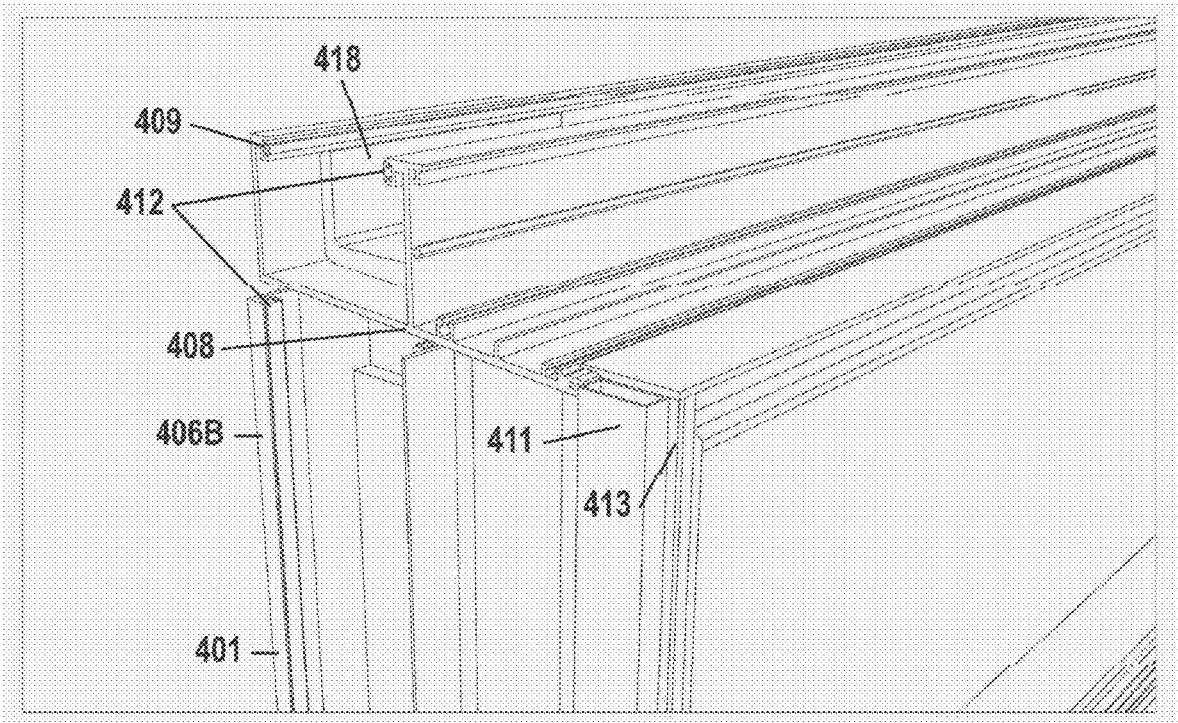
FIGS. 4A-4D illustrate closer views of the periphery of the curtainwall unit illustrated in FIGS. 3A-3D.
Figure 4B:
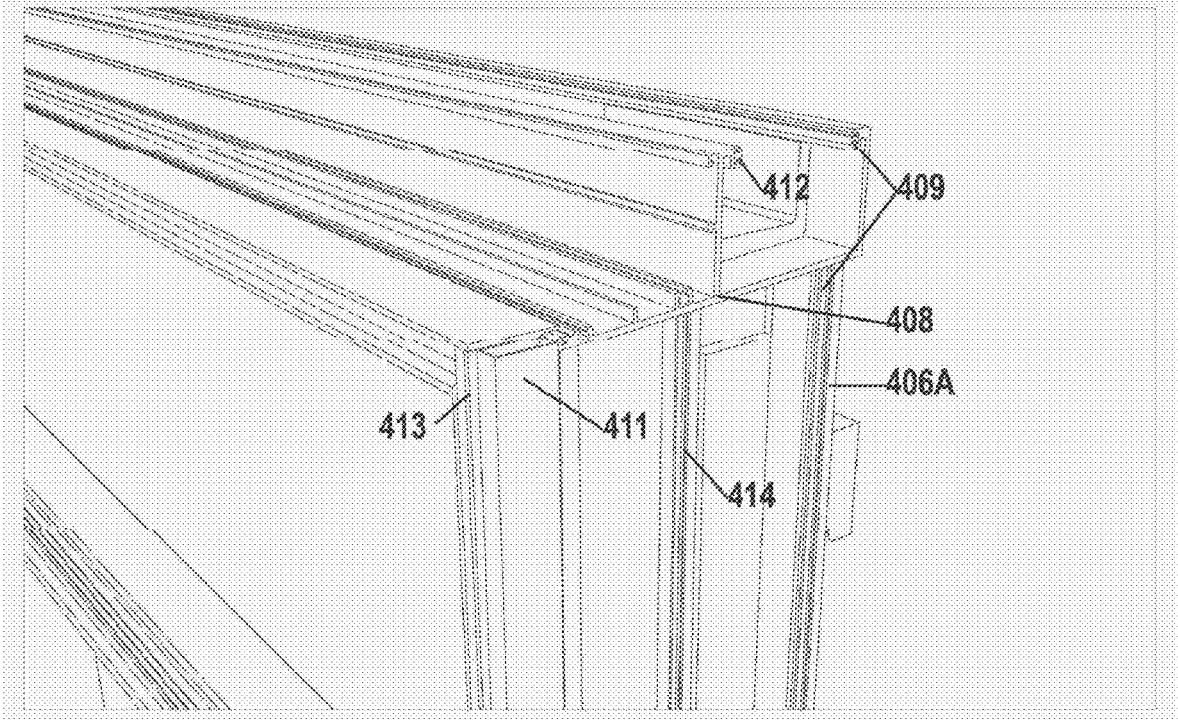
Figure 4C:
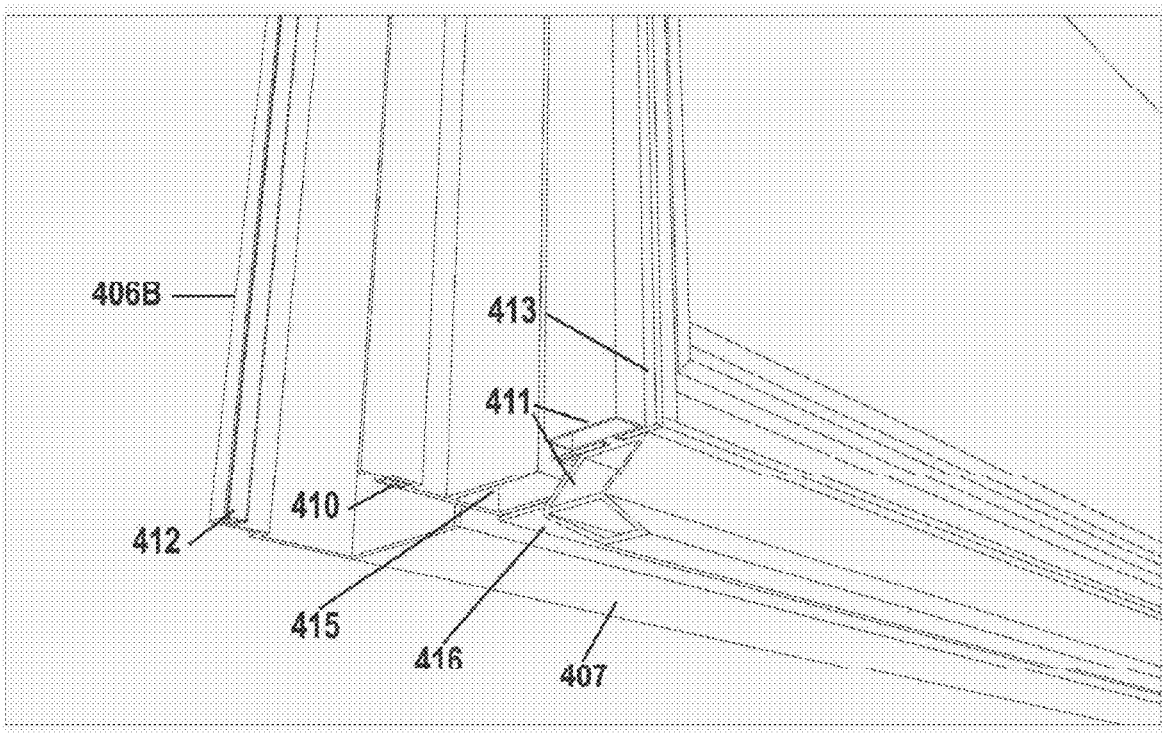
Figure 4D:
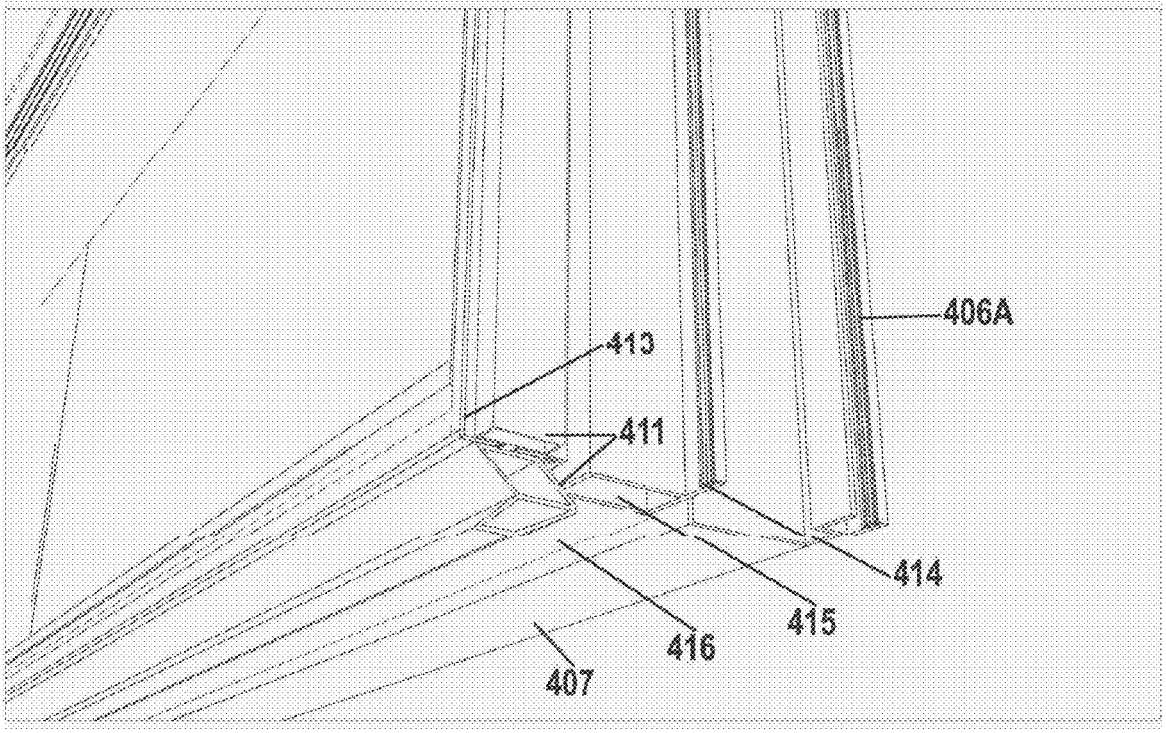

FIGS. 4A-4D illustrate closer views of the periphery of the curtainwall unit illustrated in FIGS. 3A-3D FIG. 4A illustrates a view of a top left portion of the curtainwall unit 401, FIG. 4B illustrates a view of a top right portion of the curtainwall unit, FIG. 4C illustrates a bottom left view of a curtainwall unit, and FIG. 4D illustrates a bottom right view of a curtainwall unit. The curtainwall unit 401 may include an air seal gasket 409, a plastic isolator 412, a horizontal gutter 408, a water barrier gasket 410, a male mullion 406B, a rainscreen gasket 411, a plastic blade 413, a gasket 414, a female mullion 406A, a protected vertical chamber 415, a plastic thermal shield 416, and a horizontal sill 407. The horizontal gutter 408 may also be referred to as a horizontal frame member. The horizontal gutter 408 may include the rear channel 418 formed between the air seal gasket 409 and the water barrier gasket 410. Additional detail may be found in U.S. patent application Ser. No. 16/018,520, filed on Jun. 26, 2018, and U.S. patent application Ser. No. 16/909,033, filed Jun. 23, 2020, both of which are entitled "Unitized Curtainwall Systems and Methods" and are incorporated herein by reference in their entirety.

FIGS. 5A-5D illustrate a conventional anchoring system for a curtainwall system. These figures illustrate a bracket 505 attached to a floor slab 504, similar to the bracket 205 illustrated in FIGS. 2A-2B. The bracket 505 may include slots 520 through which bolts may extend. A serrated bracket portion 521 may be used to help with preventing the bracket from sliding along the slots when the outs 522 are tightened onto the bolts. An anchor slide 523 is attached to a top portion 524 (e.g. a top portion of a vertical mullion 508, 506) of the curtainwall unit 501 and an anchor hook 564 slides into the bottom of the anchor slide 523 and is secured from sliding through the top of the slide by a screw. The anchor slide 523 may be tapped and a set screw may be placed at the top of the anchor slide 523, such that the bottom of the set screw bears on the top of the hook effectively transferring gravity load from the anchor slide 523 to the anchor hook 564. The anchor hook 525 may be placed over the lip 526 of the bracket 505 Anti-walk brackets 527 prevent the anchor hook 525 from moving laterally along the lip 526 of the bracket 505. The bottom portions of the lower row of curtainwall units hang below. Adjacent sides for adjacent lower row (LR) curtainwall units 501-LRA and 501-LRB may be hung from the same bracket 505. Adjacent upper row (UR) curtainwall units 501-URA and 501-URB are hung from the floor slab above the current floor slab. The sill of the upper row curtainwall units 501-URA and 501-URB fit within the gutter of the lower row curtainwall units 501-LRA and 501-LRB, respectively, and form a movable stack joint. The lower row curtainwall units 501-LRA and 501-LRB ride with the floor slab 504 and upper row curtainwall units 501-URA and 501-URB ride with the floor slab above the illustrated floor slab 504.

Figure 5A:
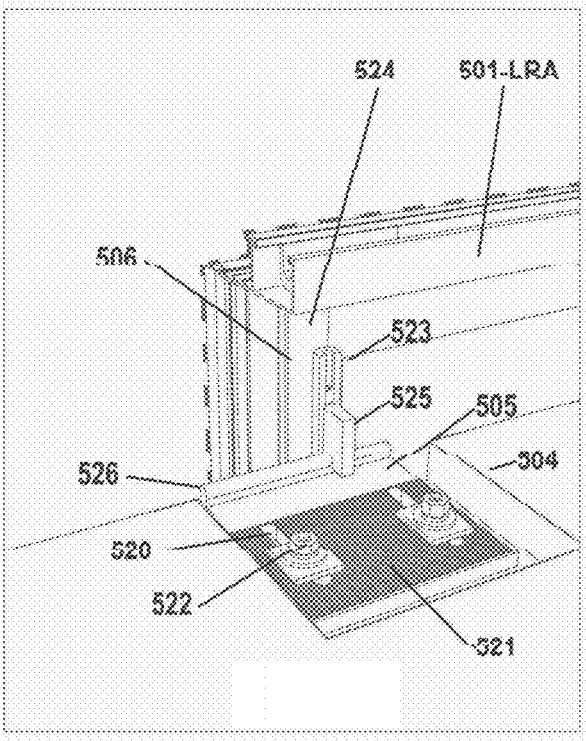
FIGS. 5A-5D illustrate a conventional anchoring system for a curtainwall system.
Figure 5B:
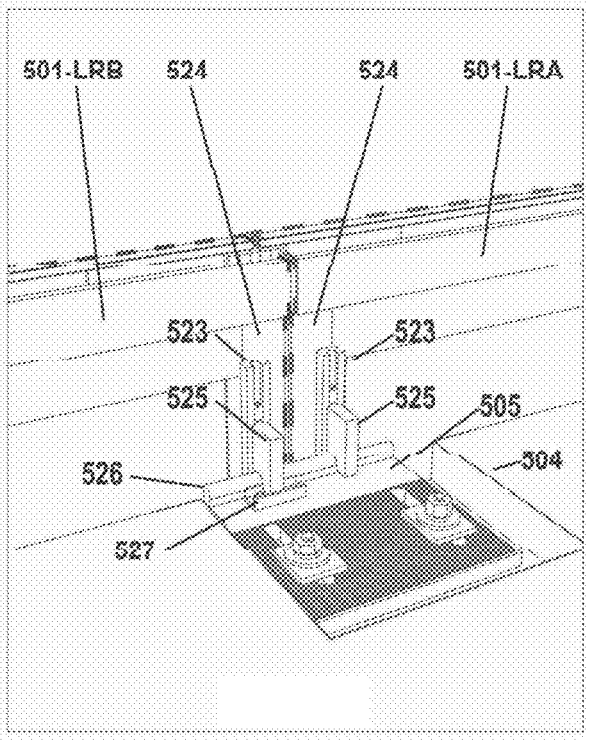
Figure 5C:
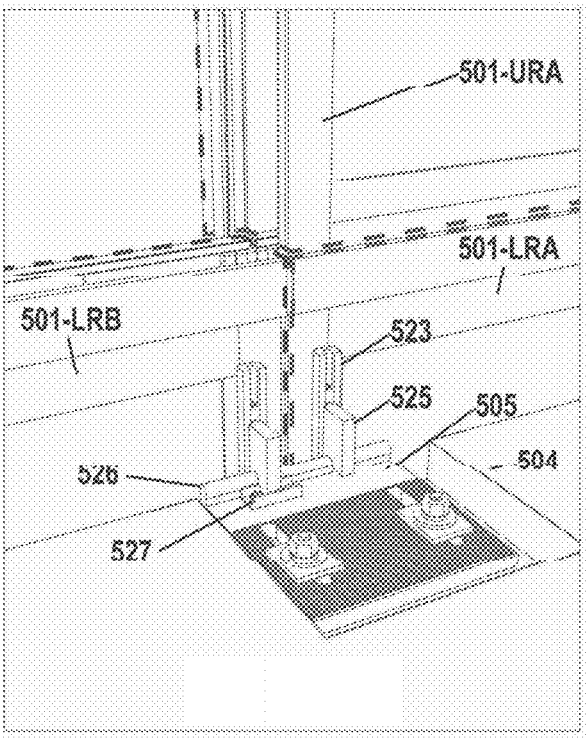
Figure 5D:
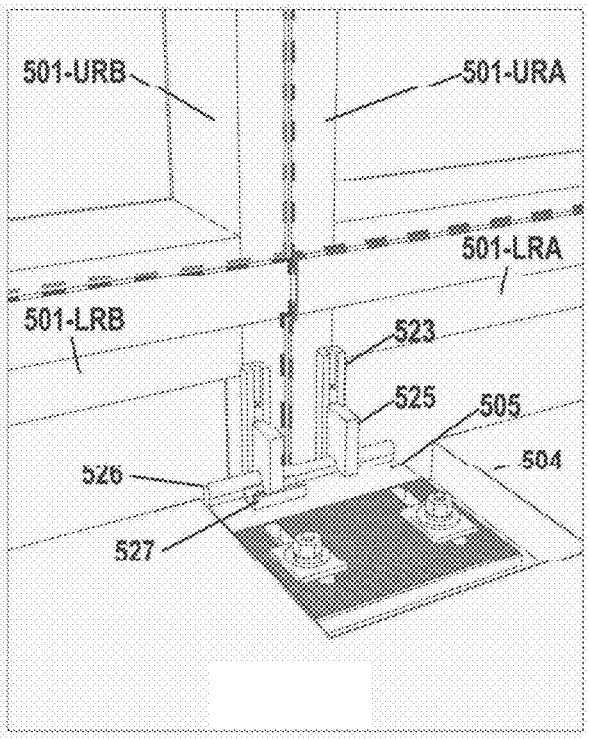
Figure 6A:
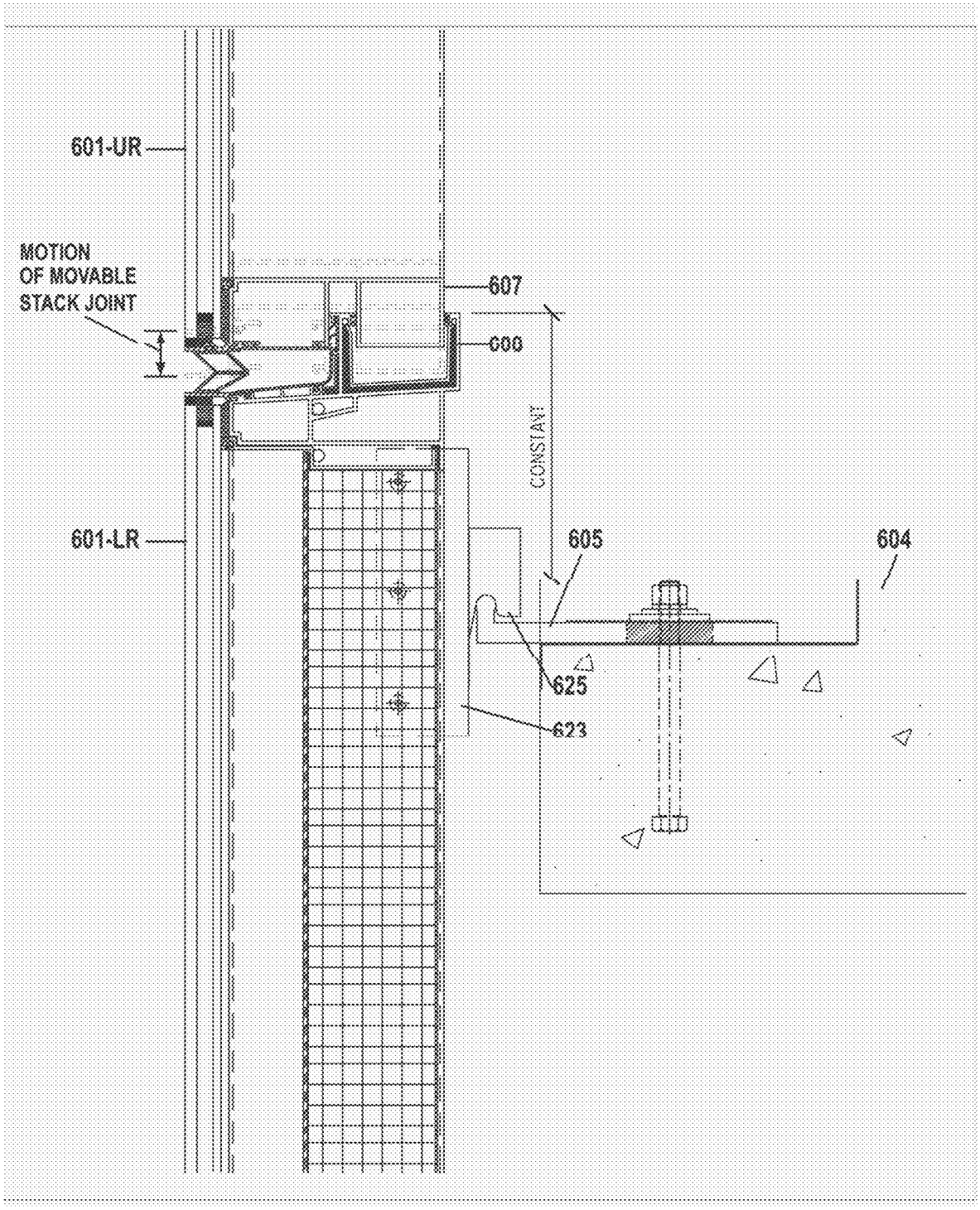
FIGS. 6A-6B illustrate side and isometric views of the conventional anchoring system illustrated in FIGS. 5A-5B, and further illustrate a static of constant dimension from a top of the curtainwall to the floor slab.
Figure 6B:
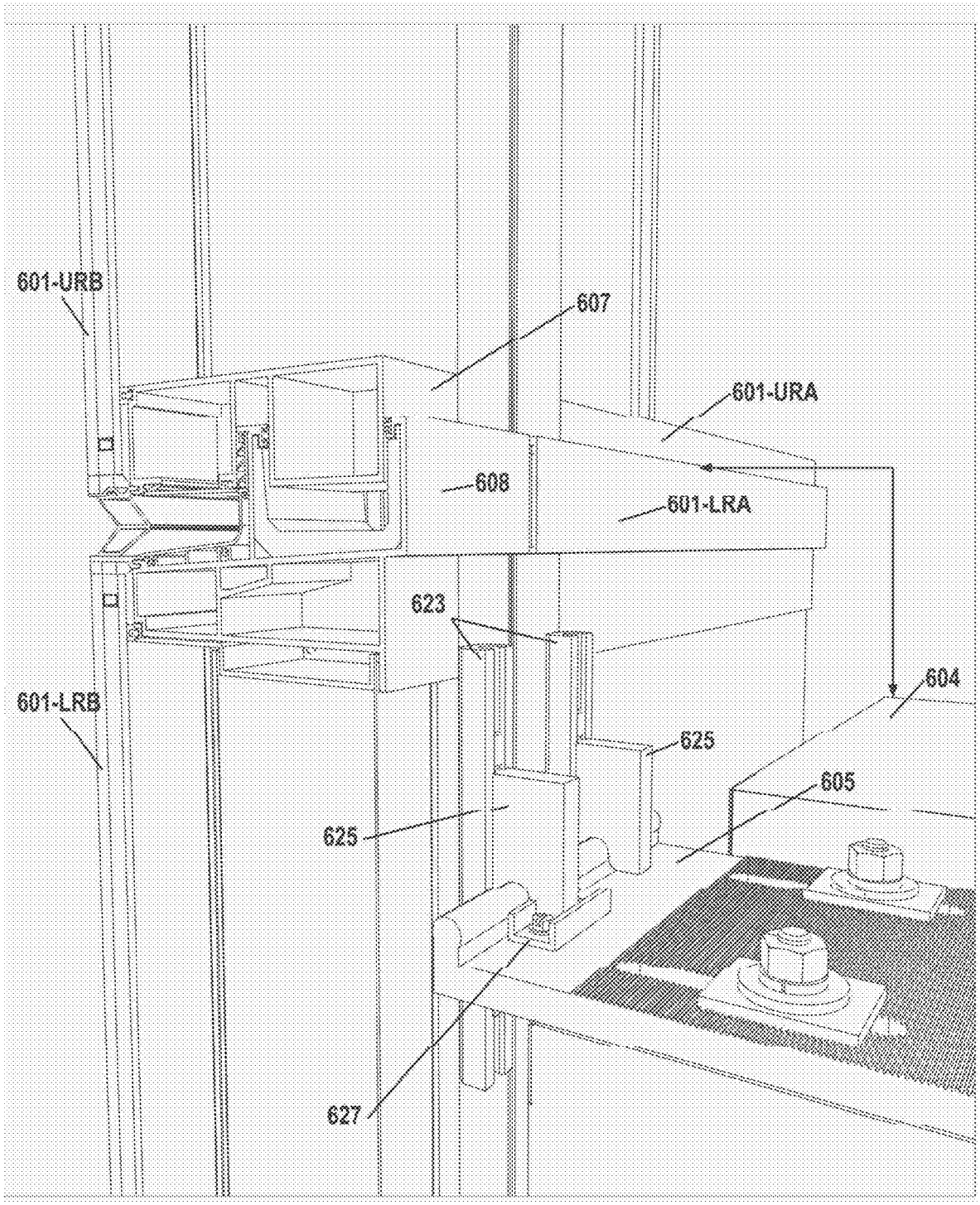

FIGS. 6A-6B illustrate side and isometric views of the conventional anchoring system illustrated in FIGS. 5A-5B, and further illustrate a state or constant dimension from a top of the lower row curtainwall unit 601-LR to the floor slab 604. The horizontal sill 607 of the top curtainwall unit 601-UR fits within and is configured to move with respect to the horizontal gutter 608 of the lower row curtainwall unit 601-LR. However, the distance from the top of the horizontal gutter 608 of the lower row curtainwall unit 601-LR to the floor slab 604 is generally fixed or constant as the anchor hook is fixed to the top portion of the bottom curtainwall unit 601-LR near the horizontal gutter 608. The load of the lower row curtainwall unit 601-LR is supported by the anchor system (anchor slide 623 attached to the top portion of the lower row curtainwall unit 601-LR, anchor hook 625 attached to anchor slide 623 and hooked on the bracket 605), and the lower row curtainwall unit 601-LR rises and falls with the Door slab 604. Similarly, the upper row curtainwall unit 601-UR is supported by, and rises and falls with, the floor slab above the illustrated floor slab 604. The isometric view of FIG. 6B shows the lower row curtainwall units 601-LRA and 601-LRB and the upper row curtainwall units 601-URA and 601-URB, the bracket 605, anchor slides 623, anchor hooks 625, and anti-walk bracket 627.

Figure 7A:
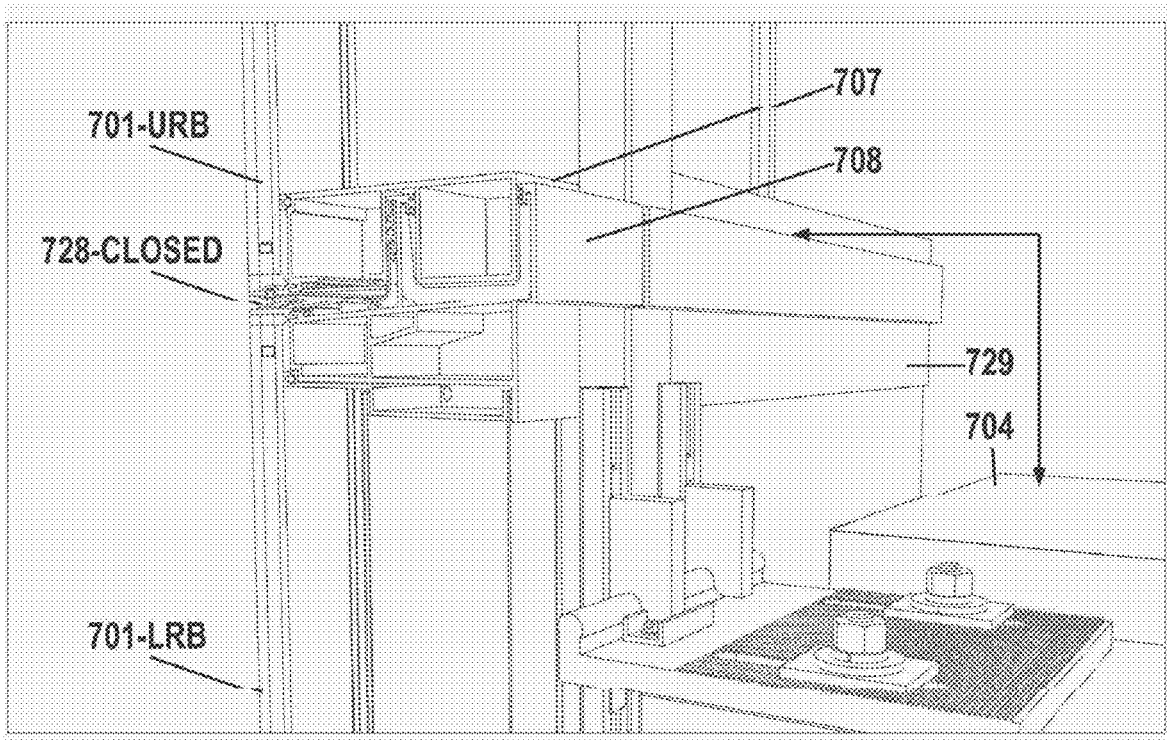
FIGS. 7A-7B illustrate isometric views of a fully-closed joint stack and fully-open joint stack, respectively, for curtain wall system using a conventional anchoring system.
Figure 7B:
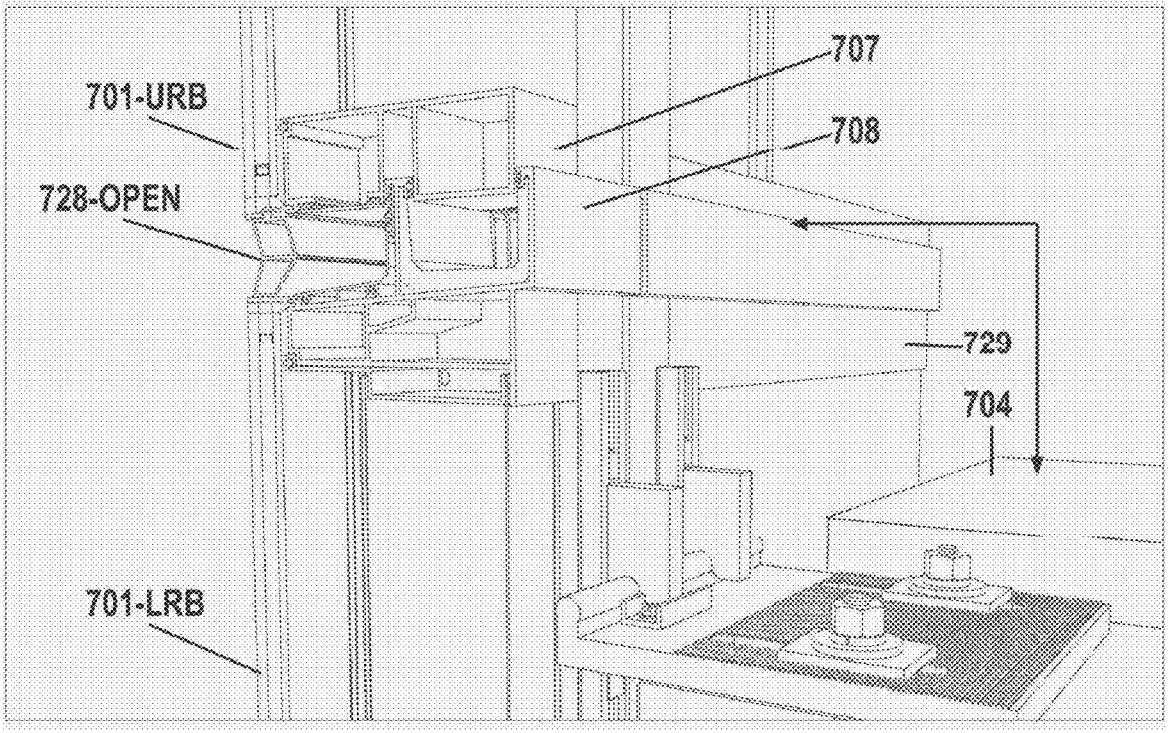

FIGS. 7A-7B illustrate isometric views of a fully-closed joint stack 728. CLOSED and fully-open joint stack 728-OPEN, respectively, for curtain wall system using a conventional anchoring system. As can be seen and is generally illustrated at 729, the distance between the top of the gutter 708 for the lower row curtainwall unit 701-LRB and the top of the floor slab 704 is generally constant, whereas the distance between the sill 707 for the upper row curtainwall unit 701-URB and the top of the floor slab 704 changes depending on the relative position between the sill 707 and gutter 708 in the movable stack joint (i.e. whether the movable stack joint is closed 728-CLOSED as illustrated in FIG. 7A or open 728-OPEN as illustrated in FIG. 7B).

Figure 8:
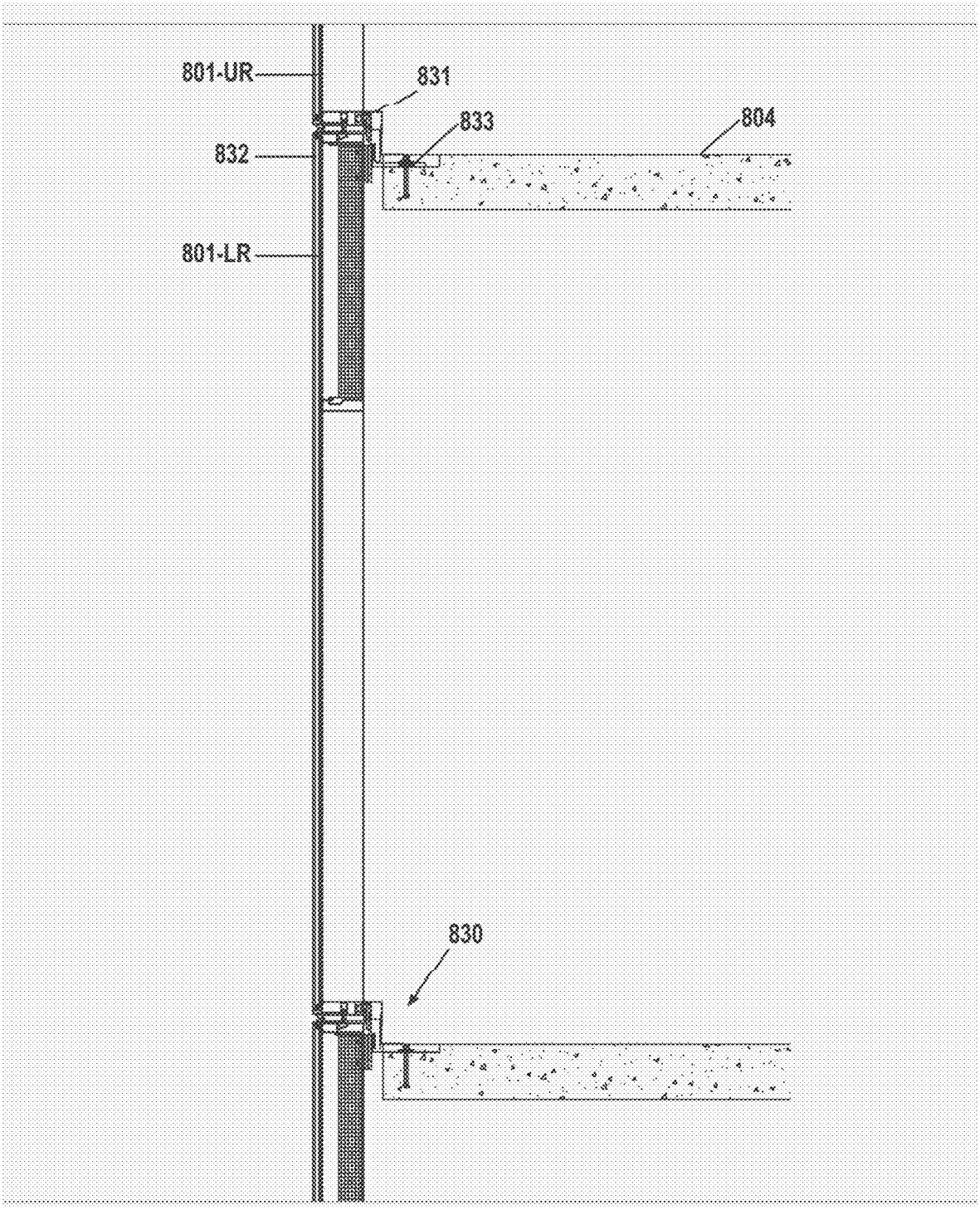
FIG. 8 is a high-level illustration of an anchoring system for a curtainwall system that provides a vertical anchor component contacting a lower portion of curtainwall to bear the load of the curtain wall unit and a horizontal anchor component to attach to the upper portion of another curtain wall.

FIG. 8 is a high-level illustration of an anchoring system 830 for a curtainwall system that provides a vertical anchor component 832 to vertically fix a lower portion of an upper row curtainwall unit 801-UR to bear the load of the upper row curtainwall unit 801-UR on a floor stab 830, and a horizontal anchor component 832 to horizontally/laterally fix the upper portion of a lower curtainwall unit 801-LR to the floor slab 804. The anchoring system 830 may include an anchor base component or structure 833, a vertical anchor component or structure 831 and & horizontal anchor component or structure 832. The anchor base component or structure 833 may be configured to be attached to the floor slab 804. The vertical anchor component of structure 831 may be configured to be attached to a lower portion of the upper row curtainwall unit 801-UR and configured to bear a gravity load of the upper row curtainwall unit 801-UR on the anchor base structure 833. The vertical anchor component or structure 831 may be configured to fix a distance between the floor slab and the lower portion of the upper row curtainwall unit while allowing horizontal motion of the lower portion of the upper row curtainwall structure. The horizontal anchor component or structure 832 may be configured to be attached to an upper portion of the lower row curtainwall unit 801-LR and to use the anchor base structure 833 to secure the upper portion of the lower row curtainwall unit 801-LR to the floor slab 804 against horizontal motion/load while allowing vertical motion of the upper portion of the lower row curtainwall unit 801-LR relative to the floor slab. The ability to allow limited vertical movement at the top of the curtainwall unit while generally fixing the horizontal position of the top of the curtainwall unit, and the ability to allow limited horizontal movement while generally fixing the vertical position at the bottom of the curtainwall unit allows the anchor system to accommodate the building movement such as vertical slab deflection from human traffic, wind load, thermal expansion, and the like.

Figure 9A:
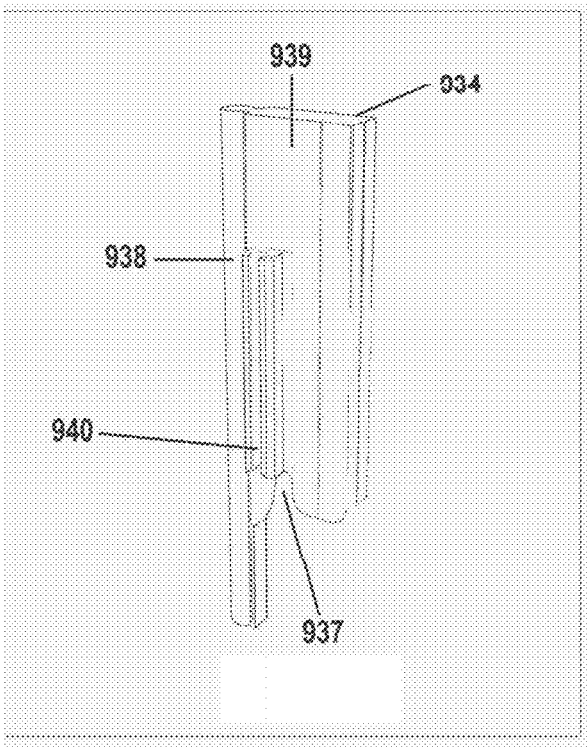
FIGS. 9A-9D illustrate, by way of example, an embodiment of an anchoring system for a curtainwall system.
Figure 9B:
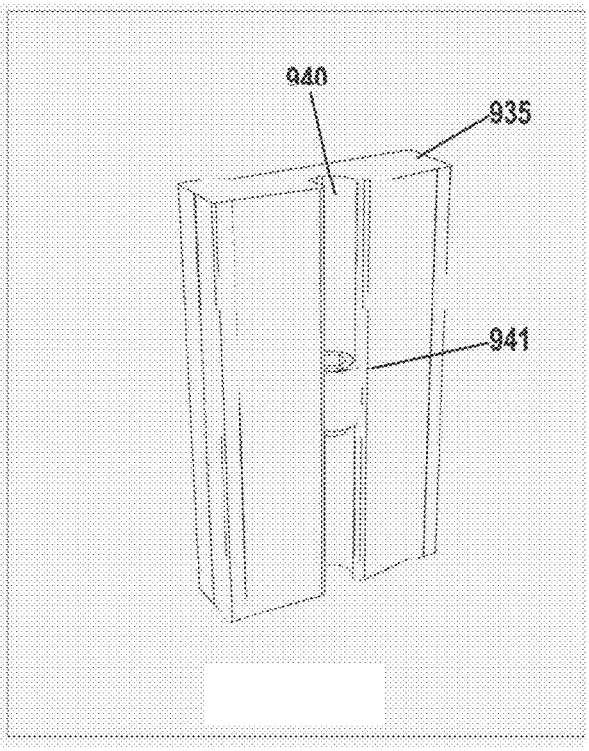
Figure 9C:
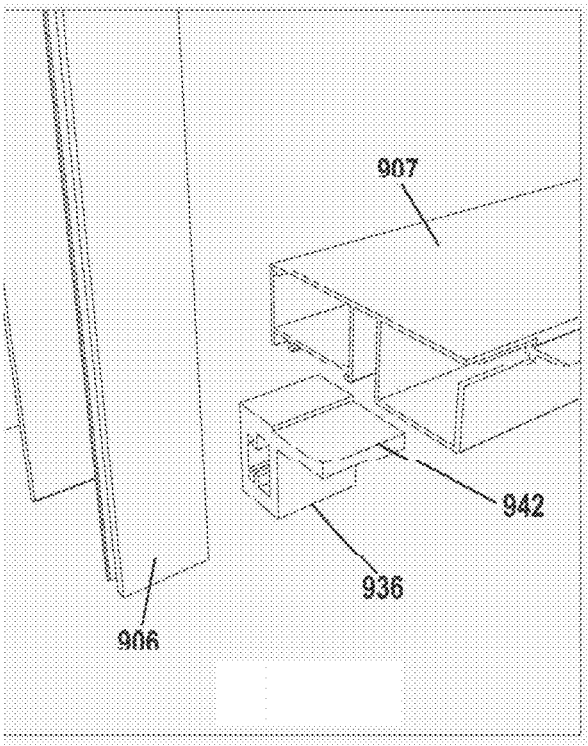
Figure 9D:
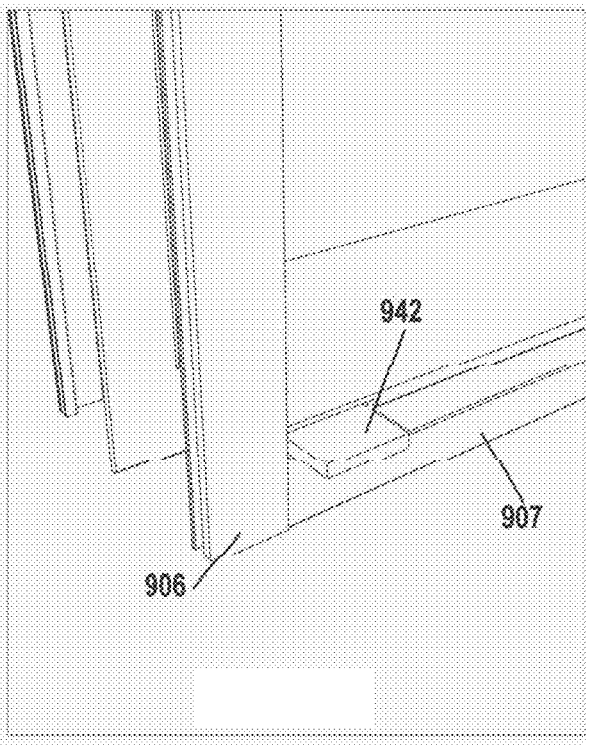

In a more specific example, the anchoring system may include components illustrated in FIGS. 9A-9D. More particularly, FIG. 9A illustrates a field-installed anchor hook 934, FIG. 9B illustrates a field-installed dead load shim 935, and FIGS. 9C-9D illustrate a deadload bracket 936 in the horizontal sill 907 of an upper row curtainwall unit 901-UR. The shapes of these components will be discussed in conjunction with the following figures.

The anchor hook 934 may include a lower recess 937 having a shape configured to receive the lip of the anchor base structure when the anchor hook is on the lip. The anchor hook 934 may also include a pin portion 938 (vertically-oriented when installed). The anchor hook 934 may include a body 939 with a fin-shape having a width less than a length and a height. The anchor hook 934 may include a tapped aperture or screw boss 940, and a set screw in the tapped aperture. In some embodiments, a screw boss 940 is formed on each side of the fin-shaped body.

The dead load shim 935 may have a vertically-oriented groove 940 configured to receive the vertically-oriented pin portion 938 of the anchor hook when the dead load shim 935 is slid over the vertically-oriented pin portion 938.

The dead load shim 935 may include a tapped aperture 941 and a set screw configured to be turned within in the tapped aperture. The set screw may be configured to be screwed into contact with a top of the pin portion 938 to adjust a height of an upper surface of the dead load shim that contacts the flat, plate-shaped extension 942 of the deadload bracket. The fit between the vertically-oriented groove 940 in the dead load shim 935 and the vertically-oriented pin portion 938 of the anchor hook 934 is precise to maintain the shim 935 in position as the set screw is adjusted to adjust the distance of the top of the dead load shim 935 from the floor slab to accommodate tolerances in the building's as-built condition relative to the theoretical location. The dimensions of the shim 935 are sufficient to support the dead load (e.g. the load attributable to at least half of the curtainwall unit if two curtainwall anchors are used such that one anchor is applied to each side of the curtainwall unit). Further, the width is sufficient to enable the shim to be below the deadload bracket within the sill. For example, the anchor slide may be attached along an edge of a vertical mullion, and the dead load bracket is installed within the sill and thus is offset from the vertical mullion The deadload bracket 936 may be configured with a flat, plate-shaped, extension 942 configured to contact the top of the dead load shim 935, thereby bearing the load (or at least its share of the load) of the upper row curtainwall unit on the dead load shim while allowing horizontal motion. The deadload bracket may be configured with a shape for insertion, during the assembly of the curtainwall units, into horizontal sills 904 of the curtainwall units. The horizontal sills 907 may have a notch 943 through which the flat, plate-shaped extension 942 is configured to extend. The dead load extension 942 may also be integrated into the base sill extrusion 907. After the dead load bracket is inserted in the sill 907, the vertical mullion 906 may be attached as part of the assembly process to form the curtainwall frame. Some embodiments may design the deadload bracket 936 to be connected as an integral part of the horizontal sill extrusion 907 instead of as a separate component.

FIGS. 10A-10H illustrate, by way of example, an installation sequence for the embodiment of the anchoring system illustrated in FIGS. 9A-9D. The anchor base structure 1033 has been installed within a recess of the floor slab 1004. Similar to known brackets illustrated in FIGS. 5A-7B, the anchor base structure 1033 may include a horizontally-oriented lip 1044 generally parallel to and aligned proximate to an edge of the floor slab when the anchor base structure is attached to the floor slab. The anchor base structure 1033 may include at least two slots 1045 generally perpendicular to the edge of the floor slab when the anchor base structure is attached to the floor slab 1004. Each of the at least two slots may be configured to allow at least one bolt 1046 to extend through for use in securing the anchor base structure 1033 to the floor slab. The anchor base structure may have a serrated surface 1047, which may cooperate with a bottom surface of a plate-like washer 1047 under another washer 1048 and not 1049 attached to the bolt 1046 to assist with securing the anchor base structure from sliding under wind loads or other loads. As illustrated in these figures, the lip 1044 of the anchor base structure 1033 may have a length along the edge of the floor slab for two installed anchor hooks 1034 used to anchor two horizontally adjacent curtainwall units.

Figure 10A:
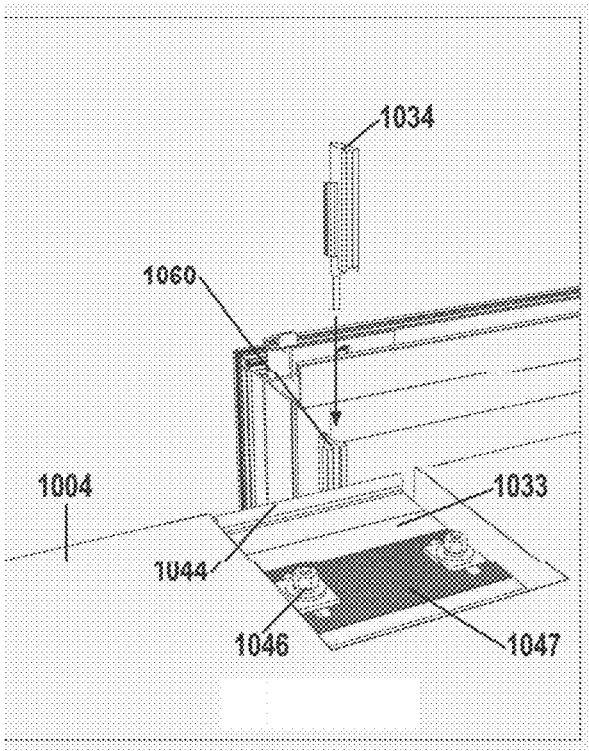
FIGS. 10A-10H illustrate, by way of example, an installation sequence for the embodiment of the anchoring system illustrated in FIGS. 9A-9D.
Figure 10B:
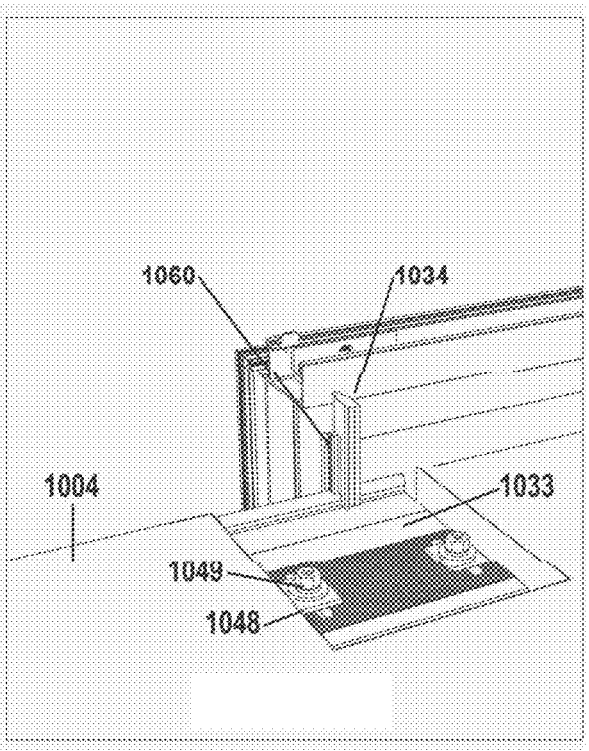
Figure 10C:
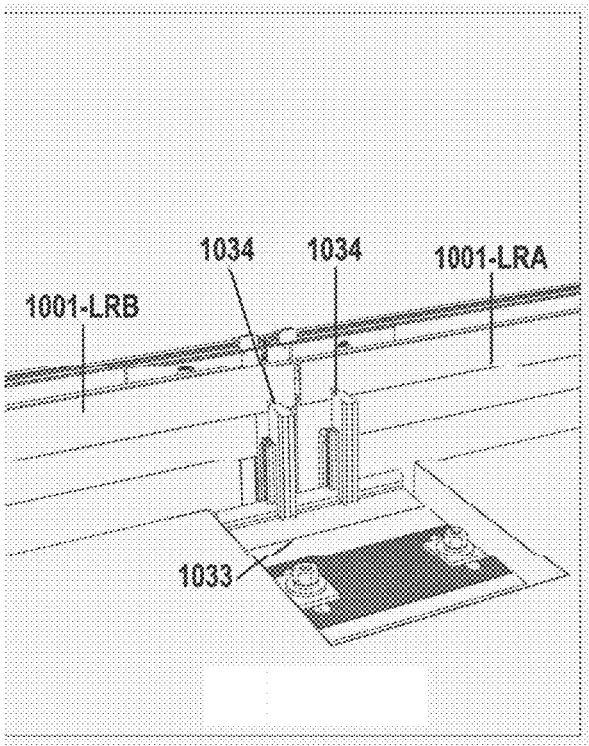
Figure 10D:
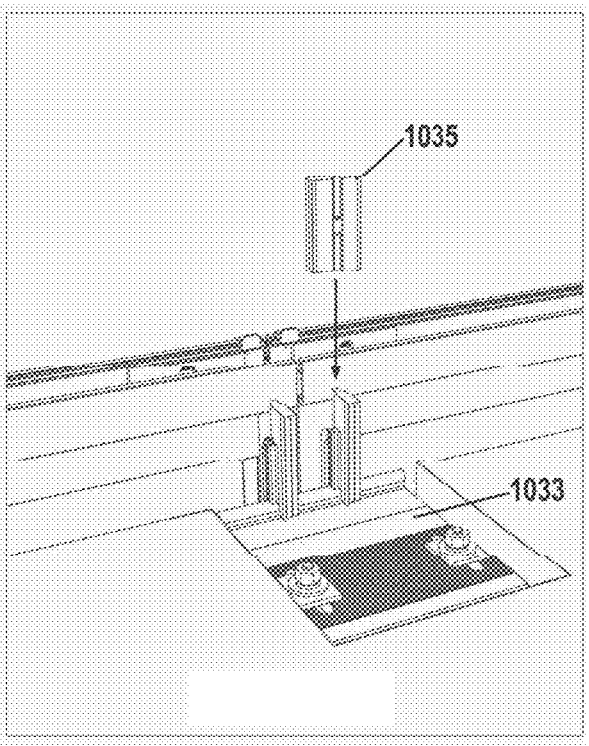
Figure 10E:
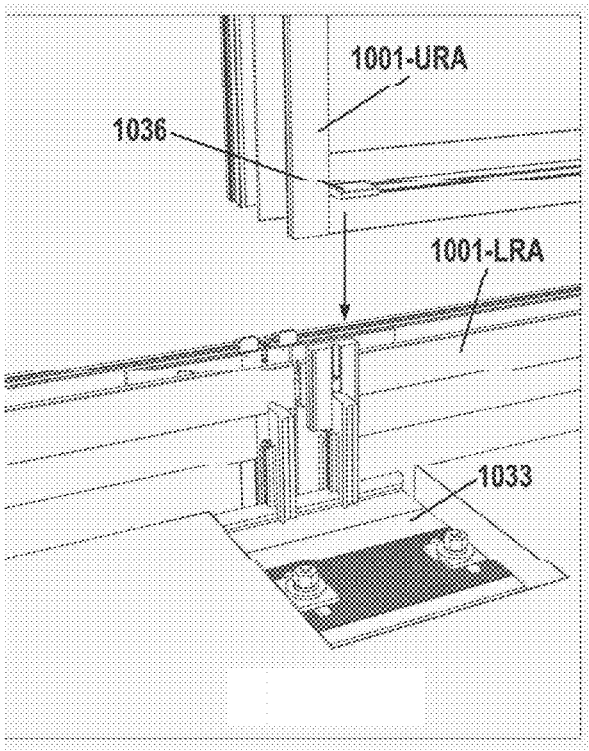

The horizontal anchor may include an anchor hook 1034 and an anchor slide 1060. The anchor hook 1034 may include a lower recess having a shape configured to receive the lip 1044 of the base plate when the anchor hook is on the lip. The anchor hook may also include a pin portion (vertically-oriented when installed). The anchor slide 1060 may be configured to be attached to the top portion of the lower row curtainwall unit 1001-LRA. The anchor slide 1060 may include a groove that is vertically-oriented when the curtain wall unit is installed. The anchor slide may be configured to receive the vertically-oriented pin portion when the vertically-oriented pin portion is slid into the anchor slide, as generally Illustrated in FIGS. 10A-10B. The pin portion may be configured to cooperate with the anchor slide to secure the top portion of the lower row curtain wall unit to the floor slab against horizontal motion/load while allowing vertical motion. The adjacent lower row curtainwall unit 1001-LRB may be installed next to the upper row curtainwall unit 1001-LRA, as ilustrated on FIG. 10C The vertical anchor structure may include the anchor hook 1034, a deadload shim 1035, and a deadload bracket 1036. The dead load shim 1035 may be configured to be installed on the anchor hook 1034, as illustrated in FIG. 10D. The deadload bracket 1036 may be configured to be attached to a bottom portion of the upper row curtainwall unit 1001-URA, as illustrated in FIG. 10E.

Figure 10F:
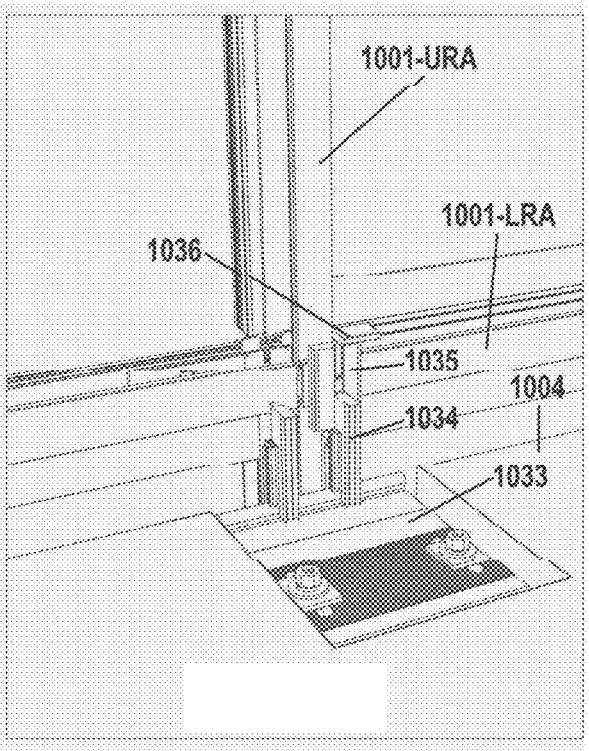
Figure 10G:
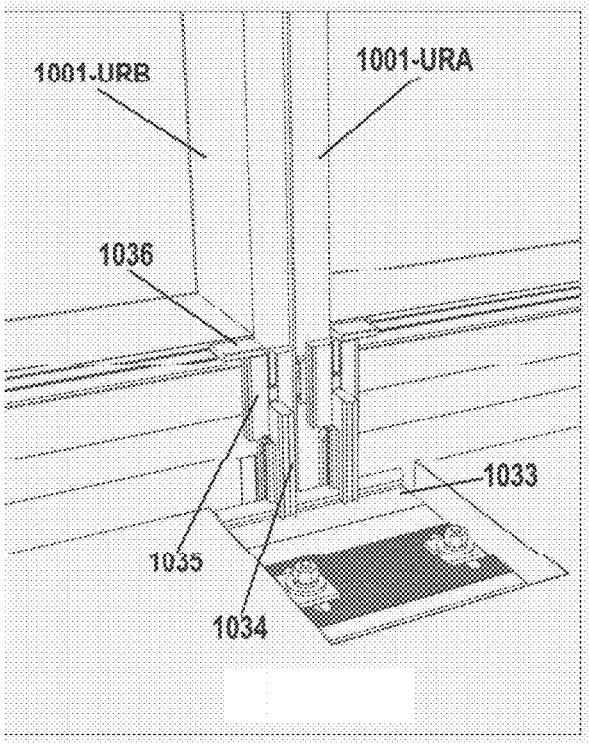
Figure 10H:
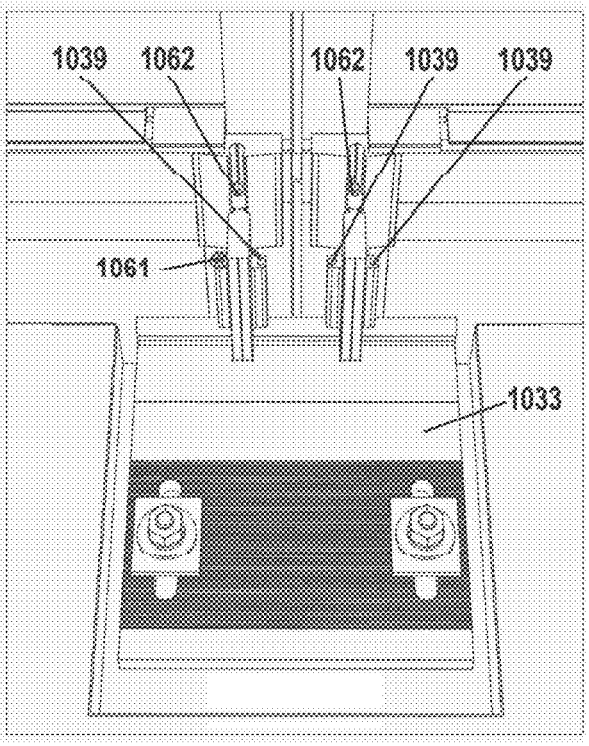

As illustrated in FIG. 10F, the deadload bracket, 1036 dead load shim 1035 and the anchor hook 1034 on the anchor base structure or plate are configured to cooperate to bear the load of the upper row curtainwall unit on the anchor base structure 1033 on the floor slab 1004, thereby fixing the distance between the floor slab and the lower portion of the upper row curtainwall unit, and to allow horizontal motion of the lower portion of the upper row curtainwall unit 1001-LRA FIGS. 10G-10H illustrate the anchor system after an adjacent upper row curtainwall unit 1001-URB is installed, where another dead load bracket 1036, dead load shim 1035 and the anchor hook 1034 on the anchor base structure or plate are configured to cooperate to bear the load of the upper row curtainwall unit on the anchor base structure 1033 on the floor slab 1004. FIG. 10H illustrate screw bosses on each side of the anchor hook 1034 and an anti-walk fastener or set screw 1050 in one of the screw bosses. A set screw within the tapped aperture of the dead load shim 1035 may be used to raise or lower the upper row curtainwall units allowing for adjustment required for the vertical tolerance of the floor slab.

Therefore, with general reference to FIGS. 10A-10H, one of ordinary skill in the art will understand, upon reading and comprehending this disclosure, that a unitized curtainwall system may be installed by attaching an anchor base structure to a floor slab, installing an upper row curtainwall unit over a lower row curtainwall unit, and installing an anchor assembly on the anchor base structure. The installation of the anchor assembly on the anchor base structure may include securing the upper portion of the lower row curtainwall unit to the floor slab against horizontal motion while allowing vertical motion of the upper portion of the lower row curtainwall unit, and bearing a gravity load of the upper row curtainwall unit on the anchor base structure, thereby fixing a distance between the floor slab and the lower portion of the upper row curtainwall unit, while allowing horizontal motion of the lower portion of the upper row curtainwall structure.

More particularly, the installation of a unitized curtainwall system may include attaching an anchor base plate to a floor slab, and sliding a pin portion of an anchor hook into an anchor slide attached to a top portion of the lower row curtainwall unit and placing a lower recess of the anchor hook over a lip of the anchor base plate (see FIGS. 10A-10B) The lower recess of the anchor hook cooperates with the lip of the anchor base plate and the pin portion cooperates with the anchor slide to secure the top portion of the lower row curtain wall unit to the floor slab while allowing vertical motion. An anti-walk fastener, such as a set screw, may be screwed through an opening in the anchor hook into the lip of the anchor base plate (see FIG. 10C). This fastener keeps the curtainwall unit from moving laterally along the lip of the bracket. The method may further include installing a dead load shim on the anchor hook onto the pin portion of the anchor hook (see FIG. 10D). An upper row curtainwall unit over the lower row curtainwall unit (see FIGS. 10E-10F). The upper row curtainwall unit may include a deadload bracket extending from a bottom portion of the lower row curtainwall unit and configured to rest on the dead load shim. The deadload bracket may be fabricated into the sill of the upper row curtainwall unit, as generally illustrated in FIGS. 9C-9D. The deadload bracket, dead load shim and the anchor hook on the anchor plate are configured to cooperate to fix a distance between the lower portion of the upper row curtain wall unit and the floor slab, as illustrated in FIG. 11A.

The method may further include using the anchor base plate to anchor an adjacent lower row curtainwall umt and upper row curtain wall unit to the floor slab. The anchor hook may include a tapped aperture and a set screw in the tapped aperture. The method may further include securing the anchor hook from lateral movement along the lip of the base plate by screwing the set screw into contact with the base plate. The dead load shim may include a tapped aperture and a set screw in the tapped aperture. The set screw may be configured to be in contact with a top of the pin portion. The method may further include adjusting a height of an upper surface of the dead load shim that contacts the flat, plate-shaped extension of the deadload bracket by rotating the set screw to either raise the height of the upper surface or rotating the set screw to decrease the height of the upper surface.

Figure 11A:
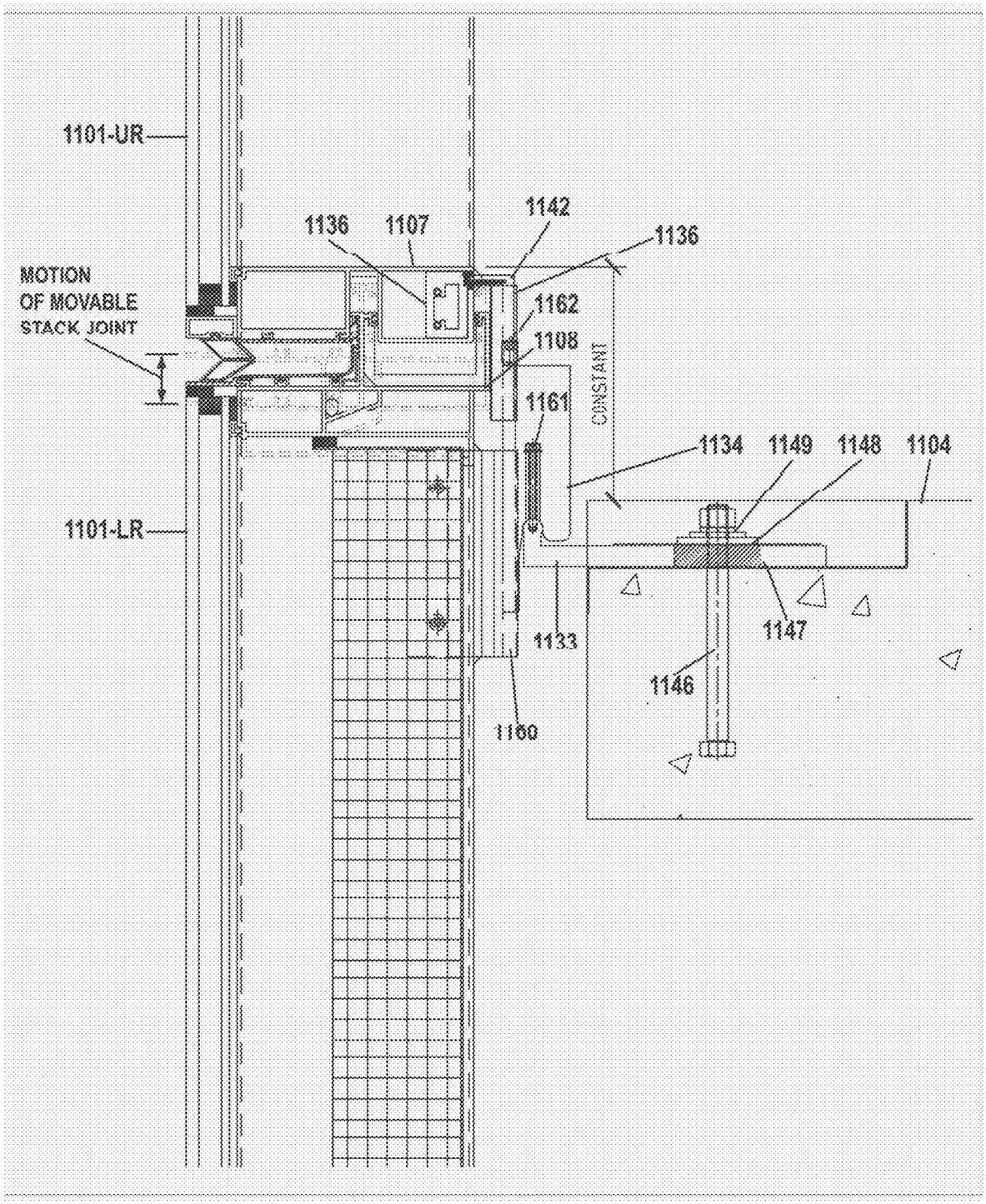
FIGS. 11A-11B illustrate a side view of an anchored curtain wall and a static or constant dimension from a bottom portion of the curtain wall to the floor slab.
Figure 11B:
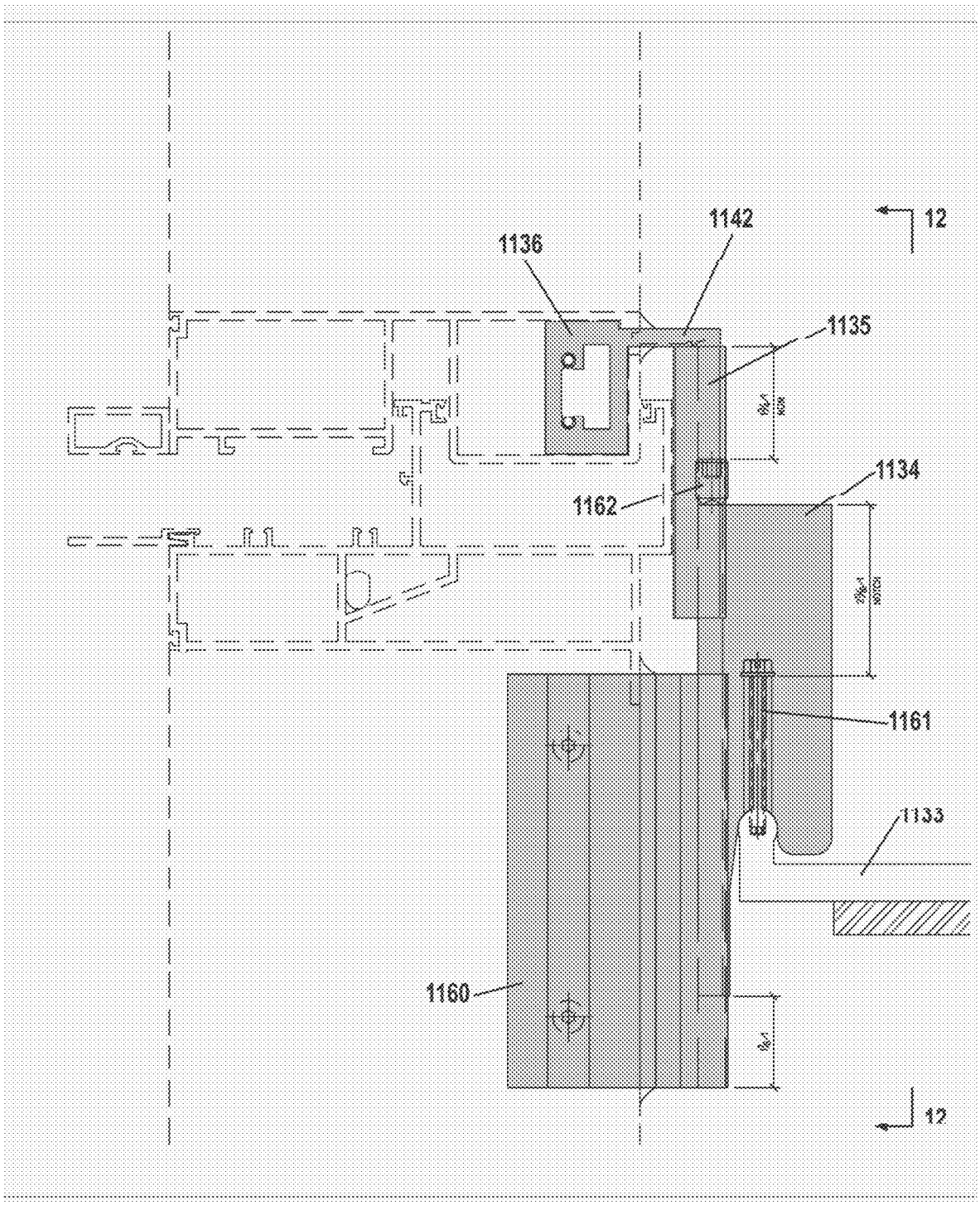

FIGS. 11A-11B illustrate a side view of an anchored curtainwall and a state or constant dimension from a bottom portion (e.g. sill 1107) of the upper row curtainwall unit 1101-UR to the floor slab 1104. The cross-section view illustrates both the fully open and fully closed positions for the movable stack joint. The horizontal sill 1107 of the upper row curtainwall unit 1101-UR fits within and is configured to move with respect to the horizontal gutter 1108 of the lower curtainwall unit 1101-LR. The figures also illustrate the deadload bracket 1136 and plate-like extension 1142, the deadload bracket 1136, the anchor hook 1134, the anchor base structure 1133, and the anchor slide 1160. The figures also illustrate the bolt 1146, serrated surface 1147, plate-like washer 1048, and another washer and not 1049. Since the position of the sill 1107 of the upper row curtainwall unit with respect to the floor slab is fixed by the dead load bracket on the deadload shim on anchor hook, which is on the lip of the anchor bracket, the fully open stack joint position occurs when the gutter 1108 of the lower row curtainwall unit moves to a low position, and the fully closed stack joint position occurs when the gutter of the lower row curtainwall unit moves to a high position FIGS. 11A-11B also illustrate the anti-walk fastener 1161 that is screwed through the anchor hook into the lip of the anchor bracket, and the set screw 1162 in the dead load shim that is configured to be rotated to raise or lower the top of the shim with respect to the top of the bracket to accommodate different dimensions within the building tolerance. FIG. 11B illustrates the deadload bracket on the top of the shim. The flat profile of the deadload bracket allows horizontal motion. However, the vertical load (dead load) is supported by the anchor bracket, anchor hook, dead load shim and anchor bracket.

Figure 12:
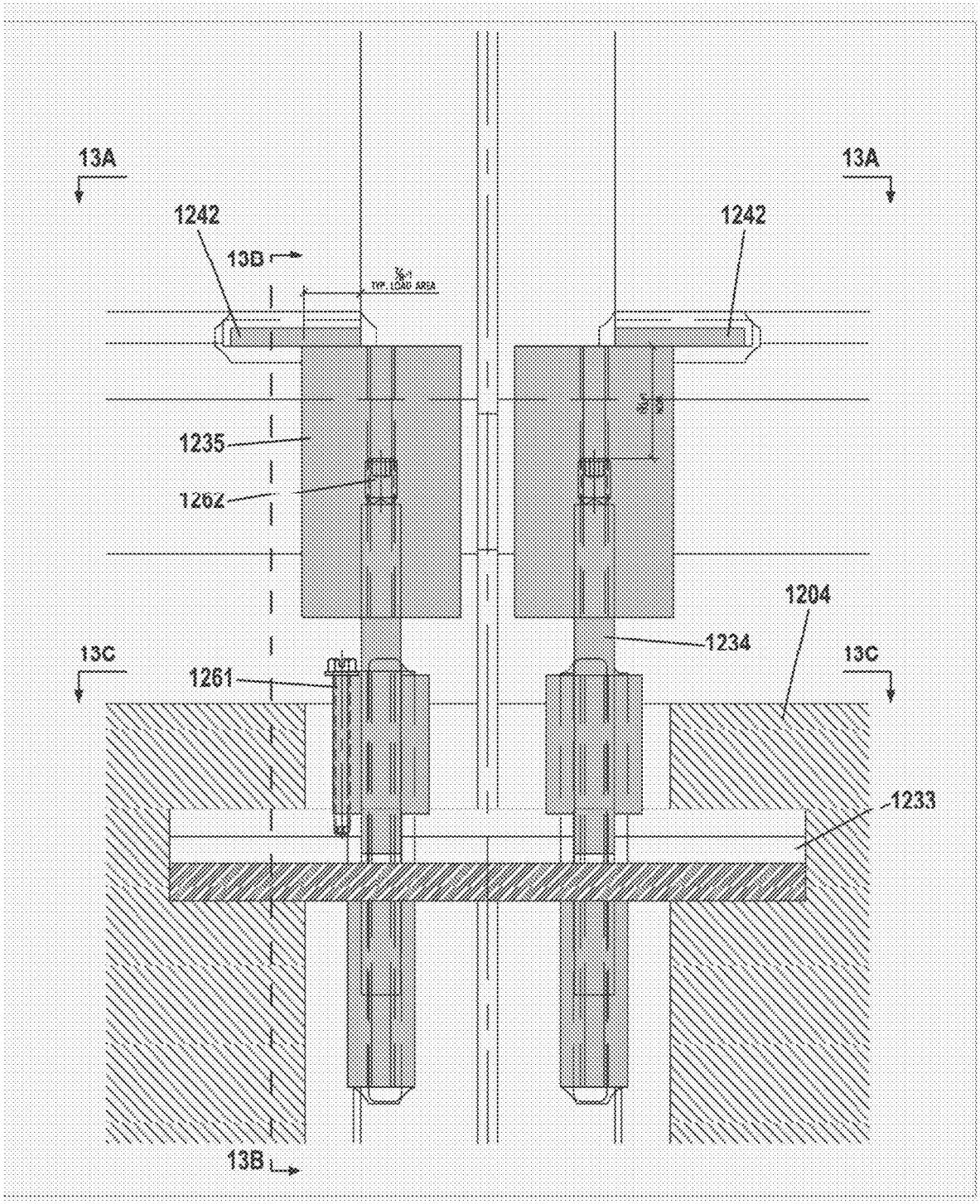
FIG. 12 illustrates a horizontal sectional view and an interior elevation view, respectively, of the anchoring system.

FIG. 12 illustrates a horizontal sectional view and an interior elevation view, respectively, of the anchoring system. The view is along line 12-12 in FIG. 11B. The illustrated view shows the anti-walk fastener 1261 (e.g., set screw) screwed into a screw boss of the anchor hook and into the lip of the anchor base structure 1233. Typically, as illustrated in FIG. 12, only one side of the unit may have an anti-walk screw to allow for thermal expansion. However, both sides may have an anti-walk screw in situations such as high seismic zones, for example, when thermal expansion/contraction can be accommodated by other means. The illustrated view also shows the set screw 1262 within a screw boss within the dead load shim 1235 and in contact with the top of the anchor hook 1234. Turning the screw one way will increase the height of the plate-like extension 1242 of the deadload bracket from the floor slab 1204 and turning the screw the other way will decrease the height of the top of the deadload bracket 1242 from the floor slab 1204. This allows the anchoring system to accommodate variations in the building as-built condition that are within tolerance.

Figure 13A:
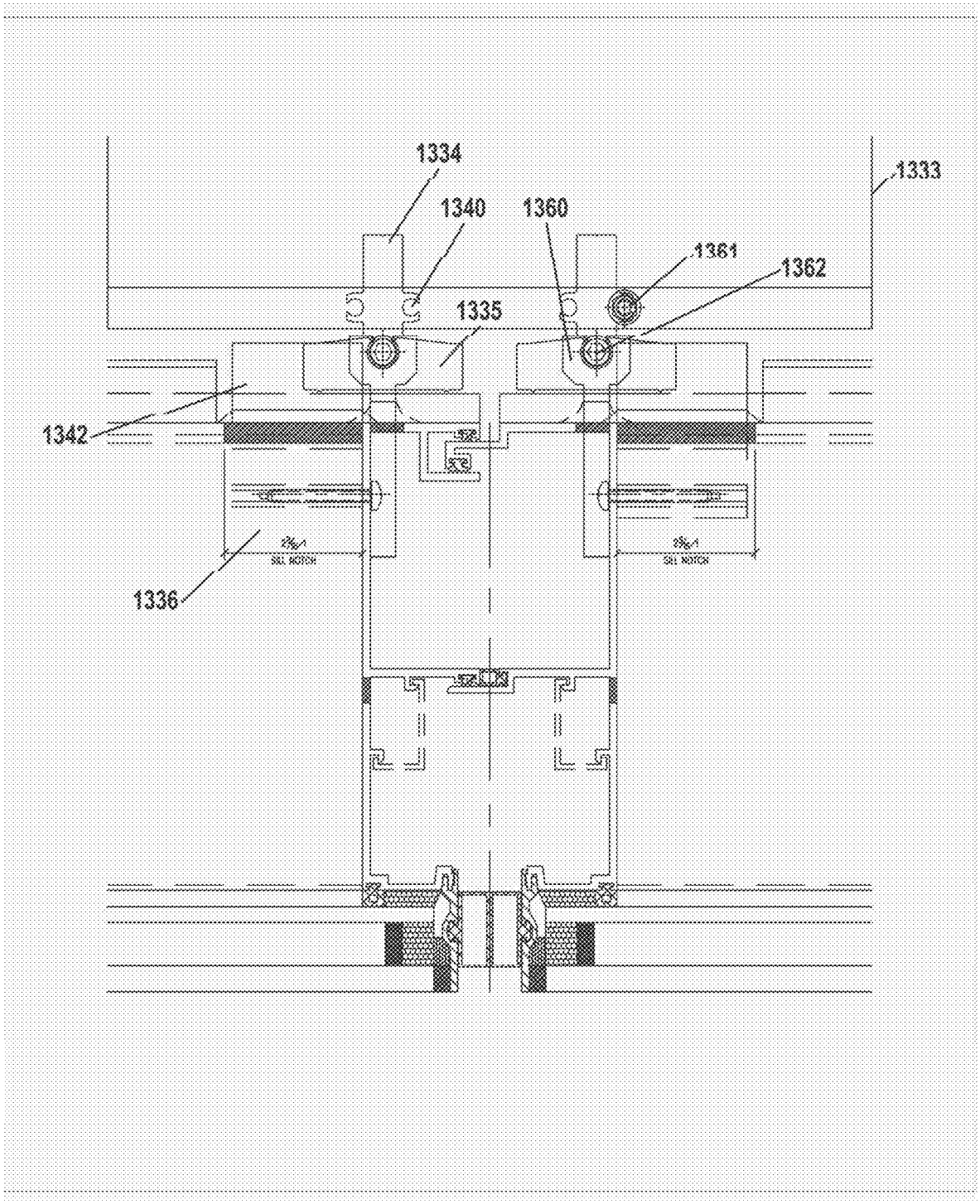
FIGS. 13A-13C illustrate various views of the anchoring system
Figure 13B:
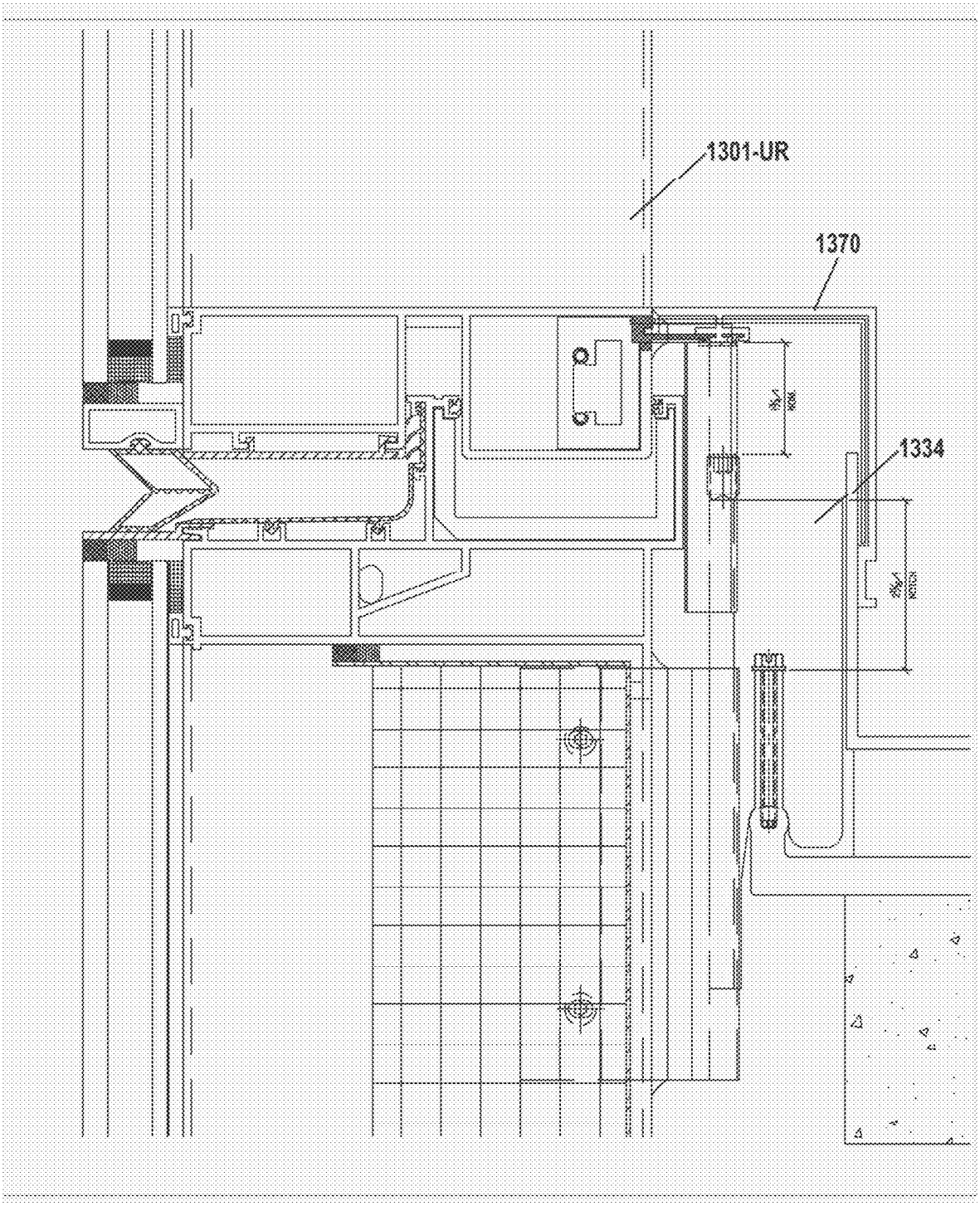
Figure 13C:
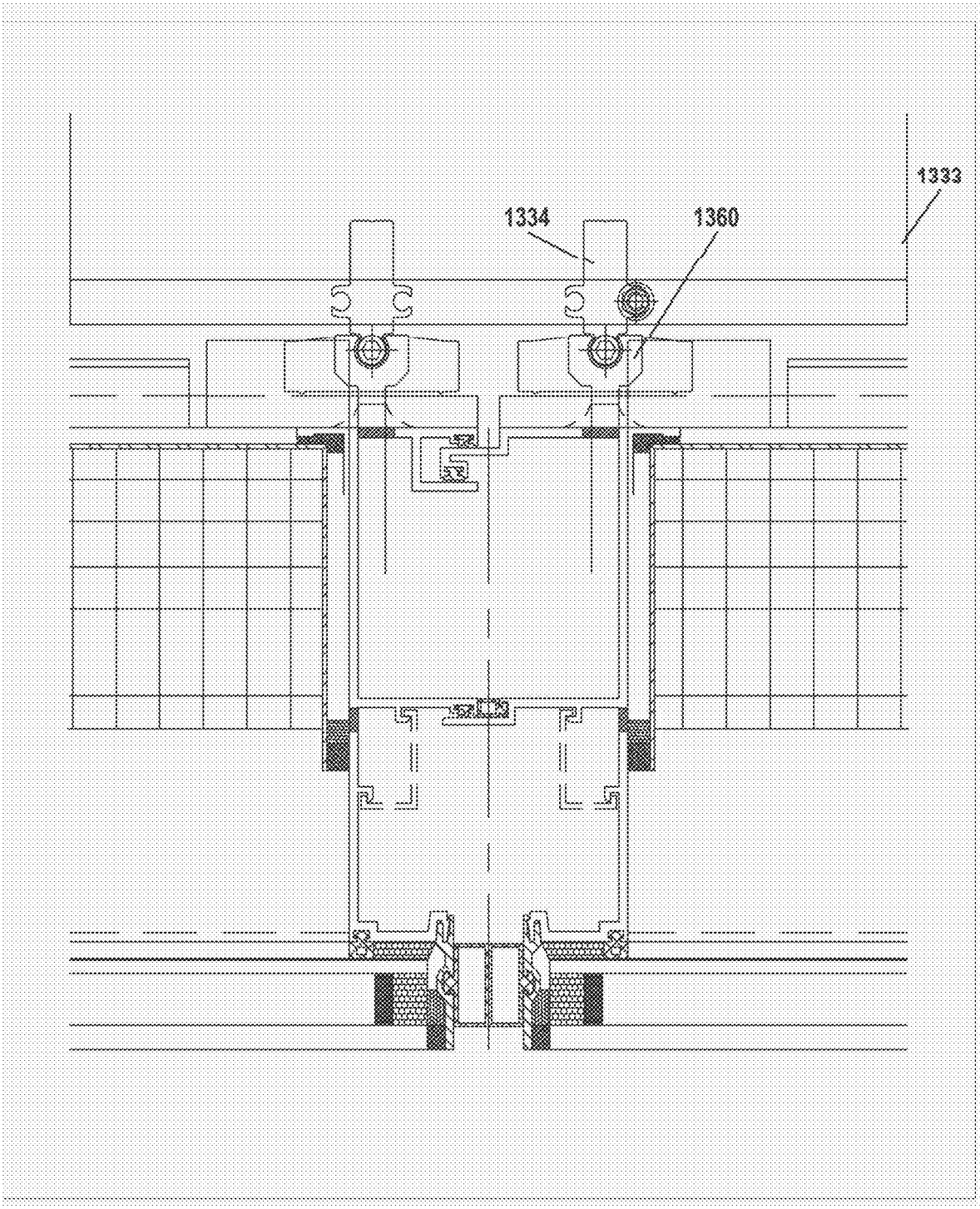

FIGS. 13A-13C illustrate various views of the anchoring system. The views of FIGS. 13A, 13B and 13C are taken along line 13A-13A and 13B-13B, respectively, in FIG. 12. The view of FIG. 13C is taken along line 13C-13C in FIG. 13A. FIG. 13A illustrates the dead load brackets 1336 within the sill of the upper row curtainwall unit, with a bracket extension 1342 resting on the dead load shim 1335, which is resting on the anchor hook 1334, which is on the anchor base structure 1333 that is attached to the floor slab. FIG. 13B provides a side cross-section view illustrating the anchoring system 1330 and sill trim 1370 that is securely attached between the upper row curtainwall unit and the floor slab need not be designed to move like an expansion joint as the lower portion of the upper row curtainwall unit 1301-UR rides with the floor slab. The trim 1370 FIG. 13C illustrates the anchor slides 1360, anchor hooks 1334, and an anchor base plate 1333

Figure 14A:
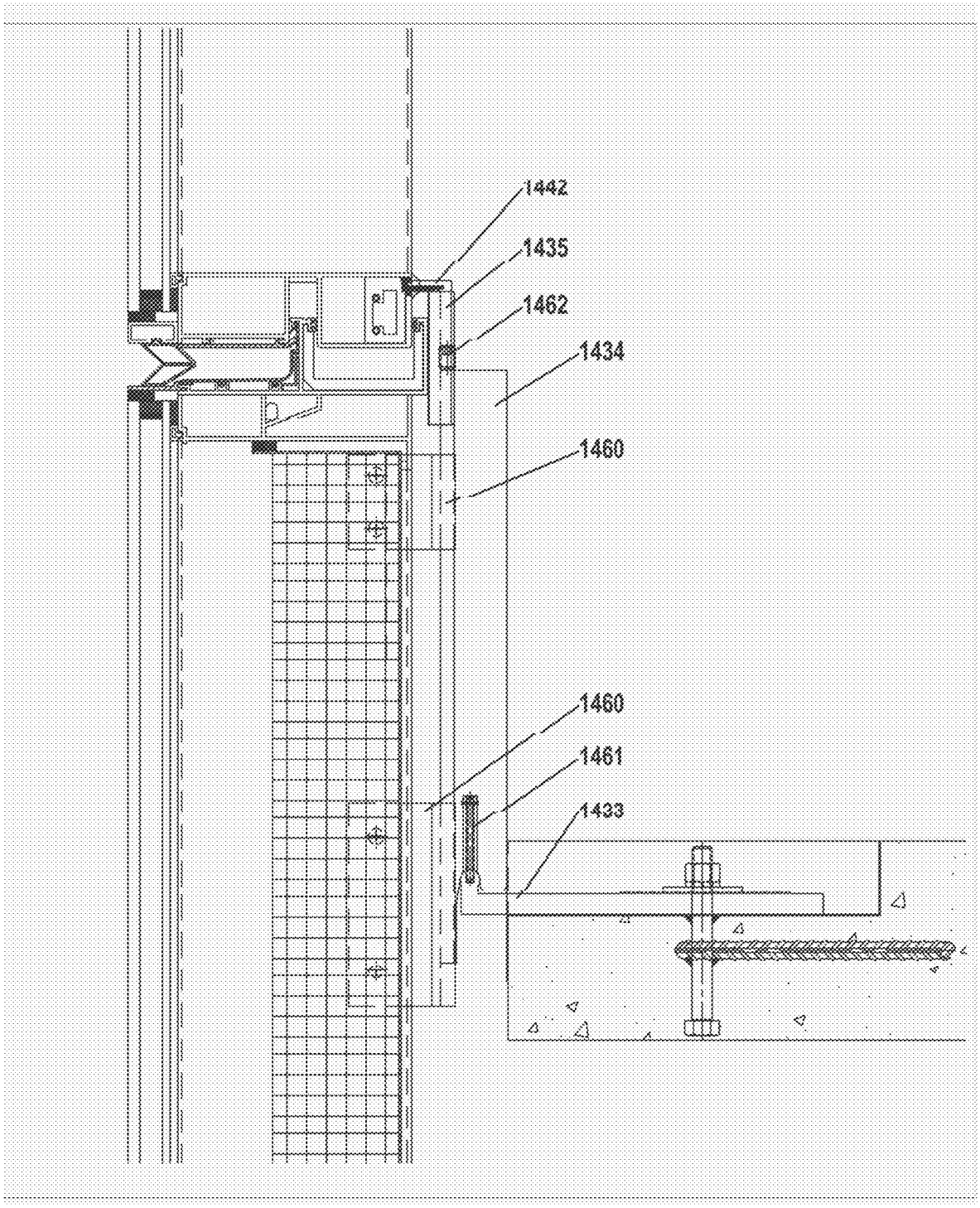
FIGS. 14A-14B illustrate an anchored curtain wall with a support bracket extending from the lower unit for use with a stack joint that is significantly above a floor slab.
Figure 14B:
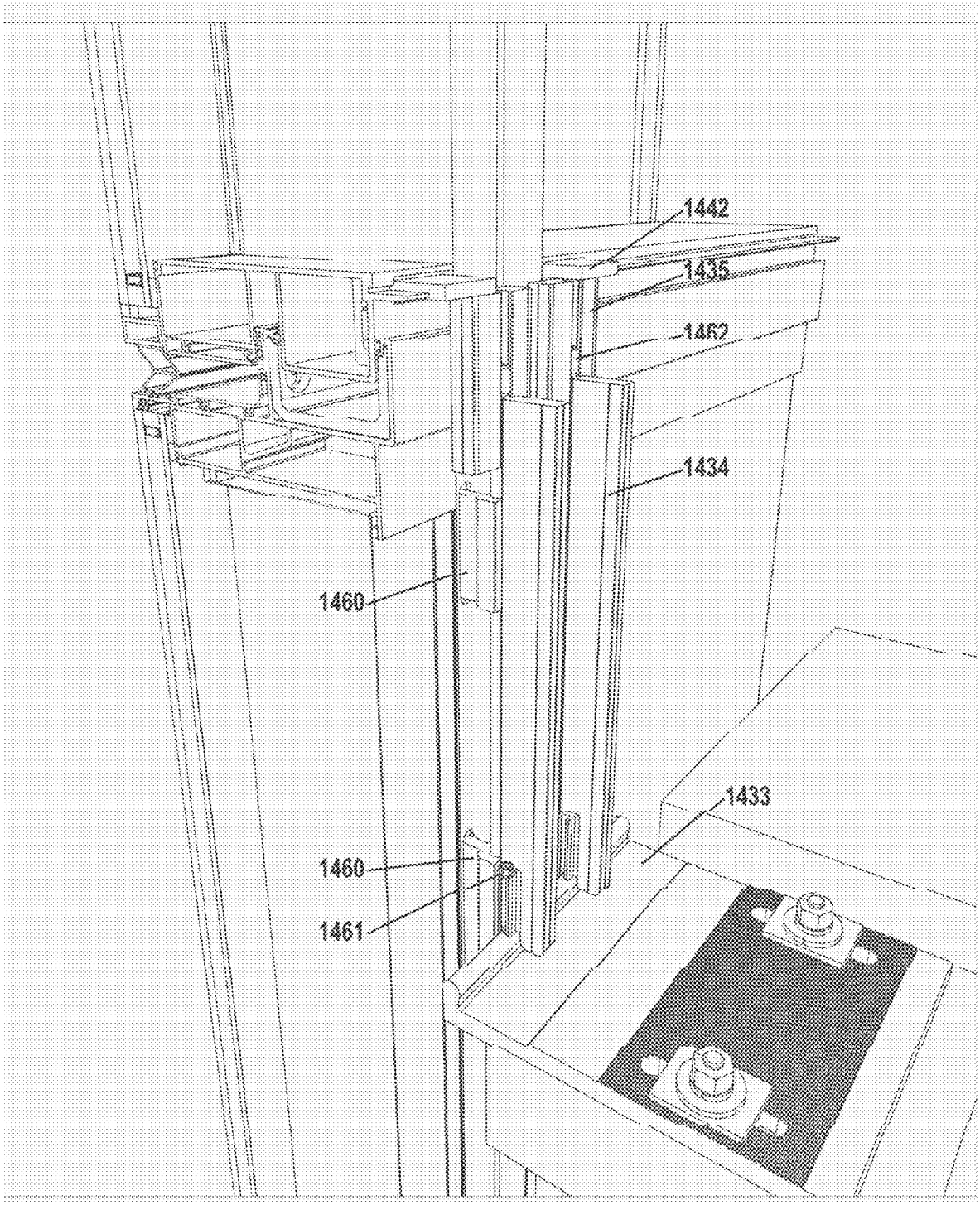
Figure 15A:
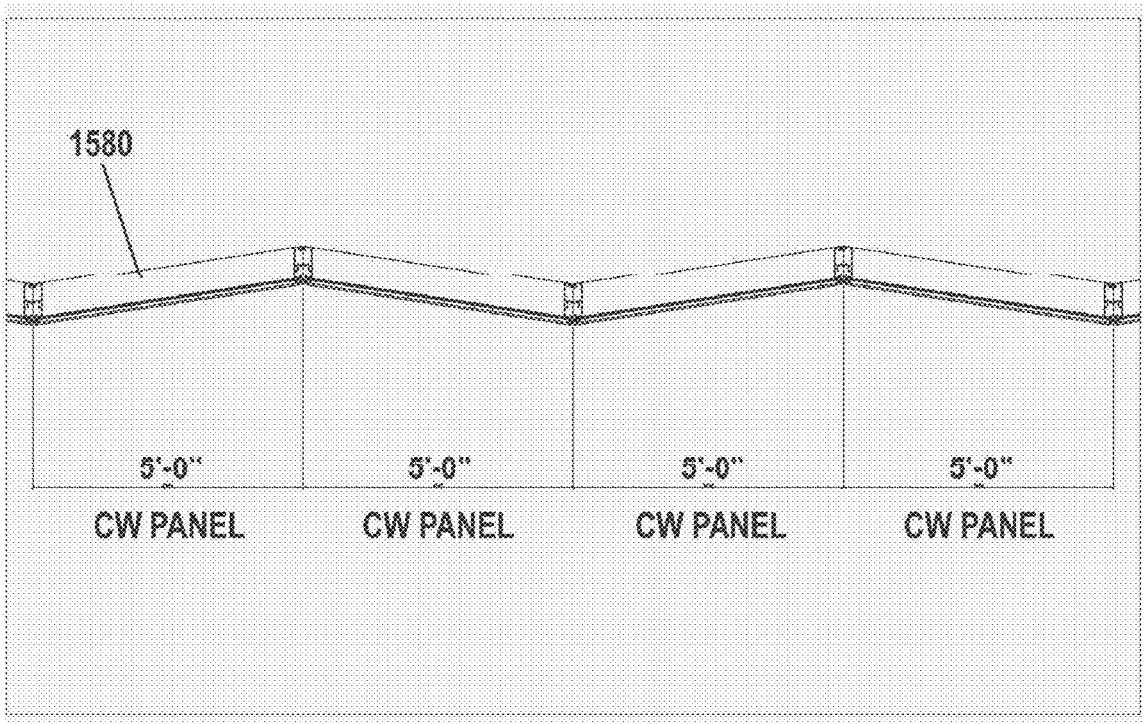
FIGS. 15A-15C illustrate an example of architectural design flexibility provided by the anchoring system, including the anchoring system enabling sill trim to be securely fixed between the lower portion of the curtainwall unit and the floor.
Figure 15B:
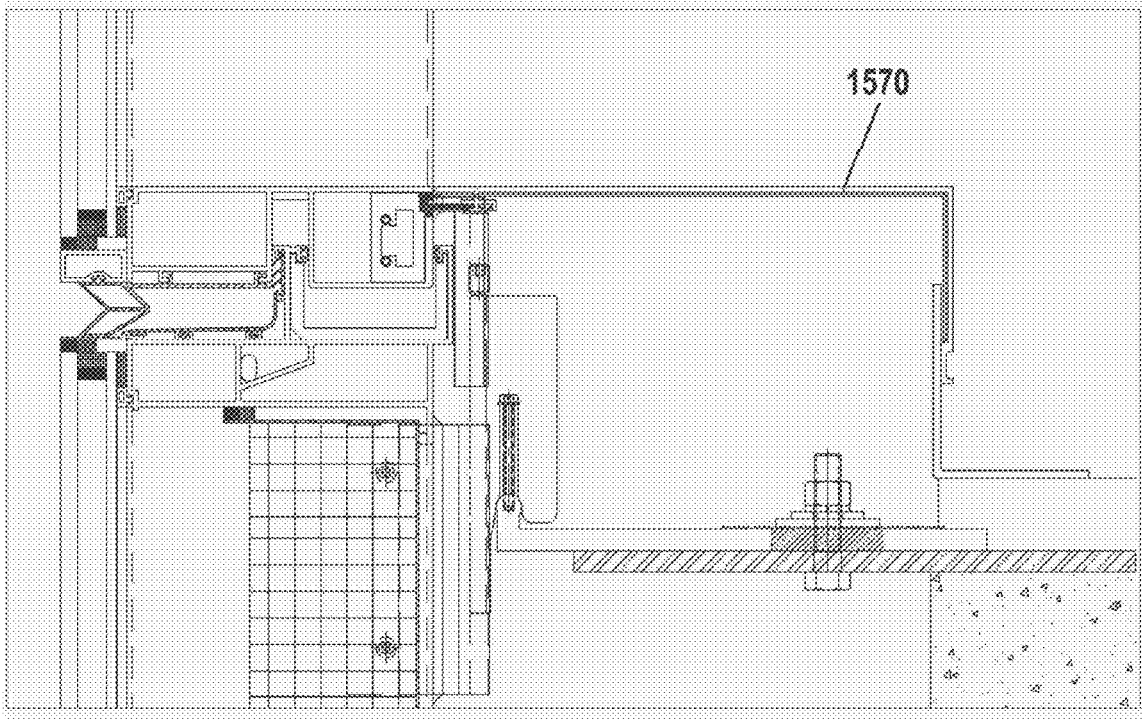
Figure 15C:
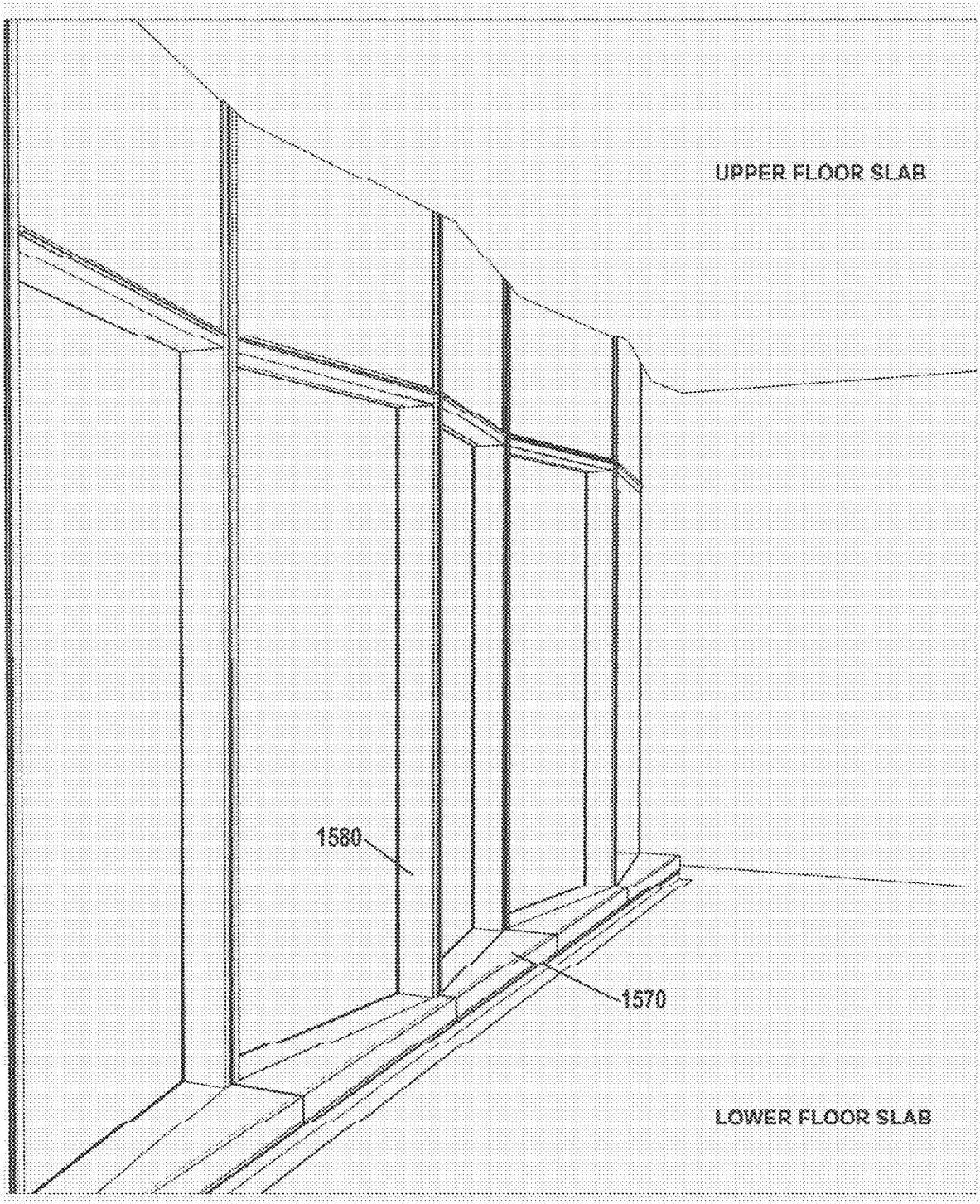

FIGS. 14A-14B an anchored curtain wall with a support bracket extending from the lower unit for use with a stack joint significantly above a floor slab. These figures illustrate the plate-like extension 1442 on the deadload shim 1435, and the set screw 1462 in the deadload shim 1435. Also illustrated is the anchor base structure 1433 The illustrated system uses an elongated anchor hook 1434 to account for the stack joint being significantly above the floor slab. The system also uses more than one anchor slide 1460 (e.g upper and lower anchor slides 1460) for use to engage with the elongated anchor hook and secure against horizontal or lateral motion/load while allowing vertical motion of the upper portion of the lower row curtain wall unit relative to the floor slab. The lower anchor slide 1460 may have an anti-walk fastener 1461 that is screwed through the anchor hook into the lip of the anchor bracket FIGS. 15A-15C illustrate an example of architectural design flexibility provided by the anchoring system, including the anchoring system enabling sill trim to be securely fixed between the lower portion of the curtainwall unit and the floor. FIG. 15A illustrates a top view of an architectural design where adjacent curtainwall units 1580 are not linearly installed. The curtainwalls do not form a planar building facade on the exterior of the building as they are installed to have a zig zag pattern of curtainwall units as generally illustrated. However, it may be desirable to use sill trim 1570, as illustrated in FIG. 15B, to provide a linear interior edge of the building. The sill trim is designed to visually hide the movable stack joint and anchor system, and provide an aesthetically pleasing view from the interior of the building. As the sill trim 1570 creates a significant surface where the building facade extends outward (see FIG. 15C), it may be desirable to design the trim to be strong enough for people to step up and stand on the trim. The present anchor system has advantages for such as design as the trim does not have to allow motion similar to motion of the stack join between the sill and the gutter of vertically-adjacent curtainwall units. Rather, the trim can have a more rigid and structurally-strong design because the distance between the sill and the floor is substantially constant.

The terms horizontal and vertical have been used to describe an orientation over various components of the curtainwall system and the anchor system. These terms are intended to convey the orientation of the components when they are installed as designed on the building. However, if used within the claims, these terms, in and of themselves, do not require the components to be installed on the building to infringe. By way of example, the anchor hook is described as having a "vertical" pin portion and the dead load shim is described as having a "vertical" groove. These components are designed so that, when they are properly installed, the pin portion and the groove are generally aligned in the vertical direction.

The above detailed description is intended to be illustrative, and not restrictive. The scope of the disclosure should, therefore, be determined with references to the appended claims, along with the full scope of equivalents to which such claims are entitled.

What is claimed is:

1. An anchoring system configured to anchor at least a lower row curtainwall unit and an upper row curtainwall unit of a unitized curtainwall system to a floor slab of a building structure, the anchoring system including:

an anchor base structure configured to be attached to the floor slab;

a vertical anchor structure configured to:

be directly connected to a lower portion of the upper row curtainwall unit;

be in direct contact with the anchor base structure and bear a load of the upper row curtainwall unit on the anchor base structure;

fix a vertical distance between the floor slab and the lower portion of the upper row curtainwall unit; and allow horizontal motion of the lower portion of the upper row curtainwall structure; and a horizontal anchor structure configured to:

be directly connected to an upper portion of the lower row curtainwall unit;

be in direct contact with the anchor base structure;

secure the upper portion of the lower row curtainwall unit against horizontal motion using the anchor base structure; and allow vertical motion of the upper portion of the lower row curtainwall unit relative to the floor slab.

2. The anchoring system of claim 1, wherein the anchor base structure includes a horizontally-oriented lip generally parallel to and aligned proximate to an edge of the floor slab when the anchor base structure is attached to the floor slab.

3. The anchoring system of claim 2, wherein the anchor base structure includes at least two slots generally perpendicular to the edge of the floor slab when the anchor base structure is attached to the floor slab, wherein each of the at least two slots is configured to allow at least one bolt to extend through for use in securing the base structure to the floor slab.

4. The anchoring system of claim 2, wherein the lip of the anchor base structure has a length along the edge of the floor slab for two installed anchor hooks used to anchor two horizontally adjacent curtainwall units.

5. The anchoring system of claim 1, wherein the horizontal anchor structure includes:

an anchor hook configured to directly contact the anchor base to secure the upper portion of the lower row curtainwall unit against horizontal motion; and an anchor slide configured to be directly attached to the top portion of the lower row curtainwall unit, wherein the anchor hook and the anchor slide are configured to cooperate to allow a vertical sliding motion to allow the vertical motion of the upper portion of the lower row curtainwall unit relative to the floor slab.

6. The anchoring system of claim 1, wherein the vertical anchor structure includes:

a deadload bracket configured to be connected to the lower portion of the upper row curtainwall unit; and a load-bearing structure configured to directly contact and extend between the anchor base structure and a bottom surface of the deadload bracket to bear the load and fix the vertical distance of the lower portion of the upper row curtainwall unit with respect to the floor slab.

7. The anchoring system of claim 6, wherein the load-bearing structure includes an anchor hook configured to directly contact the anchor base, and a dead load shim configured to extend between the anchor hook and the bottom surface of the deadload bracket.

8. The anchoring system of claim 6, wherein the deadload bracket is configured with a flat, plate-shaped extension having the bottom surface configured to contact a top of the load-bearing structure, thereby bearing the load of the upper row curtainwall unit on the load-bearing structure while allowing horizontal motion by allowing the bottom surface of the plate-shaped extension to slide on the top of the load-bearing structure.

9. The anchoring system of claim 8, wherein the deadload bracket is configured with a shape for insertion into horizontal sills of the curtainwall units, wherein the horizontal sills have a notch through which the flat, plate-shaped extension is configured to extend.

10. The anchoring system of claim 1, wherein:

the horizontal anchor structure includes:

an anchor hook configured to directly contact the anchor base to secure the upper portion of the lower row curtainwall unit against horizontal motion; and an anchor slide configured to be directly attached to the top portion of the lower row curtainwall unit, wherein the anchor hook and the anchor slide are configured to cooperate to allow a vertical sliding motion to allow the vertical motion of the upper portion of the lower row curtainwall unit relative to the floor slab; and the vertical anchor structure includes:

a deadload bracket configured to be connected to the lower portion of the upper row curtainwall unit; and a load-bearing structure configured to directly contact and extend between the anchor base structure and a bottom surface of the deadload bracket to bear the load and fix the vertical distance of the lower portion of the upper row curtainwall unit with respect to the floor slab, wherein the load-bearing structure includes the anchor hook and a dead load shim installed on the anchor hook.

11. The anchoring system of claim 10, wherein the dead load shim is configured for use to make adjustments to the vertical distance between the floor slab and the lower portion of the upper row curtainwall unit.

12. The anchoring system of claim 11, wherein the dead load shim includes a tapped aperture configured to receive set screw for adjusting the vertical distance between the floor slab and the lower portion of the upper row curtainwall unit.

13. The anchoring system of claim 10, wherein the anchor hook includes a vertically-oriented pin portion, and the dead load shim has a vertically-oriented groove configured to receive a vertically-oriented pin portion when the dead load shim is slid over the vertically-oriented pin portion.

14. The anchoring system of claim 13, wherein the vertically-oriented pin portion is configured to be slidably received by the anchor slide that is directly attached to the top portion of the lower row curtainwall unit.

15. The anchoring system of claim 10, wherein the anchor hook includes a body with a fin-shape having a width less than a length and a height, a vertically-oriented pin portion, and a lower recess having a shape configured to receive a raised portion of the anchor base structure.

16. The anchoring system of claim 10, wherein the anchor hook includes a tapped aperture configured to receive a set screw for use to secure the anchor hook from movement along the lip of the anchor base structure.

17. A method for installing a unitized curtainwall system having a plurality of curtainwall units including at least a lower row curtainwall unit and an upper row curtainwall unit, the method comprising:

attaching an anchor base plate to a floor slab;

using a horizontal anchor structure to secure an upper portion of the lower row curtain wall unit against horizontal motion using the anchor base structure, wherein the horizontal anchor structure is configured to:

directly connect to the upper portion of the lower row curtainwall unit;

directly contact the anchor base structure; and allow vertical motion of the upper portion of the lower row curtainwall unit relative to the floor slab; and using a vertical anchor structure to bear a load of the upper row curtain wall unit on the anchor base structure, and fix a vertical distance between the floor slab and a lower portion of the upper row curtainwall unit, wherein the vertical anchor structure is configured to allow horizontal motion of the lower portion of the upper row curtainwall structure.

18. The method of claim 17, further comprising using the anchor base plate to anchor an adjacent lower row curtainwall unit and upper row curtainwall unit to the floor slab.

19. The method of claim 17, further comprising turning a set screw to adjust the fixed vertical distance between the floor slab and the lower portion of the upper row curtainwall unit.

20. The method of claim 17, wherein:

the horizontal anchor structure includes:

an anchor hook configured to directly contact the anchor base to secure the upper portion of the lower row curtainwall unit against horizontal motion; and an anchor slide configured to be directly attached to the top portion of the lower row curtainwall unit, wherein the anchor hook and the anchor slide are configured to cooperate to allow a vertical sliding motion to allow the vertical motion of the upper portion of the lower row curtainwall unit relative to the floor slab; and the vertical anchor structure includes:

a deadload bracket configured to be connected to the lower portion of the upper row curtainwall unit; and a load-bearing structure configured to directly contact and extend between the anchor base structure and a bottom surface of the deadload bracket to bear the load and fix the vertical distance of the lower portion of the upper row curtainwall unit with respect to the floor slab, wherein the load-bearing structure includes the anchor hook and a dead load shim installed on the anchor hook.

* * * * *